United States Patent [19]

Black et al.

[11] 3,941,053

[45] Mar. 2, 1976

[54] PRINTING PRESS

[75] Inventors: James A. Black, Kent City; James O. Rop, Grandville, both of Mich.

[73] Assignee: James A. Black, Kent City, Mich.

[22] Filed: Sept. 27, 1973

[21] Appl. No.: 401,383

[52] U.S. Cl. ..... 101/124; 101/126; 101/127.1

[51] Int. Cl.[2] B41F 15/20; B41F 15/36; B41F 15/44

[58] Field of Search..... 101/127.1, 128.1, 124, 101/123, 114, 115

[56] References Cited

UNITED STATES PATENTS

| | | | |
|---|---|---|---|
| 2,179,220 | 11/1939 | Schneider | 101/124 |
| 2,219,603 | 10/1940 | Shurley | 101/124 |
| 2,555,096 | 5/1951 | Reinke | 101/124 |
| 3,120,180 | 2/1964 | Black et al. | 101/124 |
| 3,139,823 | 7/1964 | Landesman | 101/124 |
| 3,260,194 | 7/1966 | Karlyn | 101/124 X |
| 3,577,914 | 5/1971 | Ronge | 101/124 |
| 3,673,954 | 7/1972 | Lala | 101/124 X |
| 3,774,534 | 11/1973 | Ichinose | 101/119 |
| 3,780,652 | 12/1973 | Black et al. | 101/124 |

*Primary Examiner*—Edgar S. Burr
*Assistant Examiner*—R. E. Suter
*Attorney, Agent, or Firm*—Price, Heneveld, Huizenga & Cooper

[57] ABSTRACT

A screen printing press employs a screen carriage securing a printing screen frame and screen therein and which reciprocates through print and return strokes over a reciprocally rotating print cylinder. Printing stock is advanced between the print cylinder and the screen during printing strokes. The screen carriage includes a disengageable drive which permits feeding print stock through the machine without effecting printing thereon. The screen carriage further includes adjustable screen frame holding means to which the screen frame is slidably mounted permitting partial or total removal of the screen frame from the screen carriage. A fully adjustable squeegee means and flow coater assembly is positioned above the screen and is provided for elevating and longitudinally shifting the flow coater and squeegee assembly away from the printing area for inspection and maintenance of the press. The screen carriage includes cam means for positively engaging squeegee support means for controllably lowering the squeegee to the screen during each printing stroke. Externally adjustable side registration means are provided to permit adjustment of the print stock registration during operation of the press.

23 Claims, 27 Drawing Figures

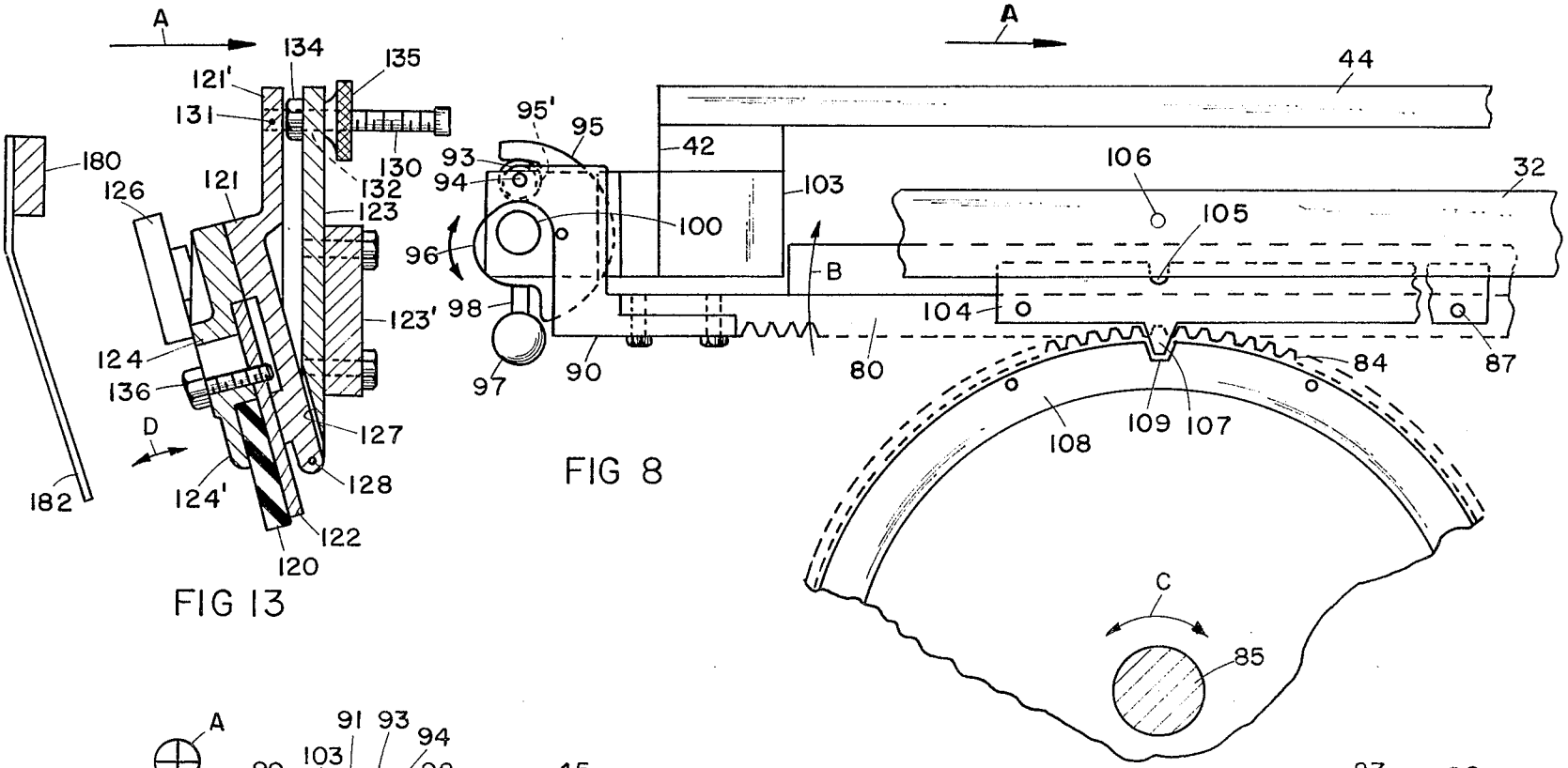
FIG 8
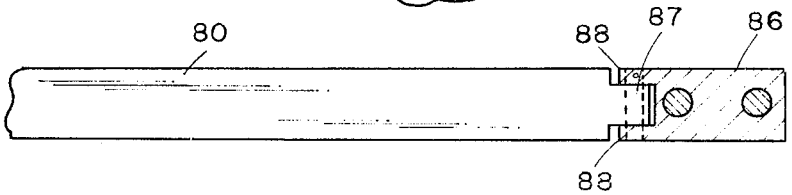
FIG 7
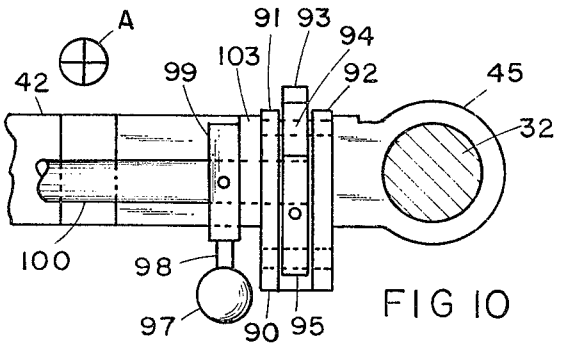
FIG 10
FIG 13

PRINTING PRESS

BACKGROUND OF THE INVENTION

The present invention relates to improvements in screen printing presses.

In screen printing presses of the type in which sheet stock is advanced through a printing station between a reciprocating print cylinder and printing screen, frequently it is necessary to make a variety of adjustments with respect to the registration of the paper, squeegee or other components when setting up the press for printing a run. Likewise, it is frequently necessary to clean or otherwise maintain or repair the printing press in the immediate printing area.

In existing screen printing presses, if adjustments or maintenance is necessary during a printing run or when initially setting up the press for a run, it is necessary to remove the printing screen frame from the screen frame cariage to obtain necessary access to the components requiring adjustment. Also with conventional presses, the squeegee and flow coater mechanism which is positioned immediately above the printing cylinder typically obstructs access to the print cylinder area where registration adjustments must be made or other maintenance or repairs performed.

Thus, with conventional screen presses, frequently the entire flow coater and squeegee mechanism and printing screen frame must be removed before or during a printing run to make relatively minor adjustments. This can greatly increase the down time of the printing press. Additionally, if an adjustment or repair is required in the middle of a printing run where ink has been applied to the squeegee, flow coater and printing screen; the task can become even more burdensome and time consuming since ink must be cleaned which frequently will drip onto various components of the press during removal of the parts for completion of the repairs or adjustments.

At least a partial solution to the various problems with conventional presses has been provided by the screen press described in U.S. Pat. No. 3,120,180 issued on Feb. 4, 1964 to the present assignee. The press therein disclosed employs what has become known in the industry as a high lift squeegee and flow coater mechanism which provides structure for elevating the squeegee and flow coater assembly upwardly from the printing area such that access to the registration means for the print stock or other apparatus in the printing area can be had either before or during a printing run.

Although this press represents a tremendous improvement in the screen printing art, the printing press of the present invention incorporates structure permitting even greater access for adjustments or maintenance. The present press provides a greater degree of flexibility of operation and adjustments of the components required for registration of the printing stock, the squeegee and the positioning of the screen frame.

SUMMARY OF THE INVENTION

Apparatus embodying the present invention includes a screen printing press having a print cylinder and reciprocating screen frame carriage carrying a screen frame thereon for reciprocal motion during print and return strokes of each cycle of printing operation. Means are provided for feeding printing stock into the printing station between the printing cylinder and printing screen and for providing adjustable side registration while the press is in operation. A movable flow coater and squeegee assembly is positioned above the printing screen for forcing ink through the screen and onto the printing stock during a print stroke. According to one aspect of the present invention, means are provided for adjustably elevating and/or longitudinally moving the flow coater and squeegee assembly away from the printing area for adjustment or maintenance.

Means are provided for disengaging the screen carriage from the drive mechanism to permit printing stock to be advanced into the press without reciprocating the screen frame thereby permitting dry runs to be made verifying the accurancy of feed and registration of the printing stock.

According to still another aspect of the present invention, means are provided for adjustably and slidably mounting the screen frame within the reciprocating screen frame carriage. Another aspect of the present invention is the provision of means for positively raising and lowering the squeegee during return and print strokes respectively.

Accordingly, it is an object of the present invention to provide an improved screen printing press.

Another object of the present invention is to provide a screen printing press with improved squeegee adjustment means.

Another object of the present invention is to provide improved means for controllably lowering the squeegee onto the printing screen.

A further object of the present invention is to provide a screen frame carriage disengageable from drive means therefor.

An additional object of the present invention is to provide improved means for registering paper fed to the printing area.

Still a further object of the present invention is to provide improved means for moving the squeegee and flow coater subassemblies between operable and non-operable positions to permit ready access to the printing area of the press for service.

Yet another object of this invention is to provide an improved screen frame carriage facilitating mounting and adjustment of a printing screen frame therein.

These and other objects of the present invention will become apparent upon reading the following description thereof together with the accompanying drawings in which:

BRIEF DESCRIPTION OF THE DRAWINGS

FIG. 7 is a fragmentary cross-sectional view of a portion of the apparatus shown in FIG. 6 taken along the section lines VII—VII of FIG. 6;

FIG. 8 is a fragmentary, side elevational view of the outer side of the right rearward end of the screen frame carriage;

FIG. 10 is a fragmentary, left side elevational view of the structure shown in FIG. 8;

FIG. 13 is an enlarged cross-sectional view of a portion of the apparatus shown in FIG. 11 taken along the section lines XIII—XIII of FIG. 11;

DETAILED DESCRIPTION OF THE PREFERRED EMBODIMENT

Figure 1:
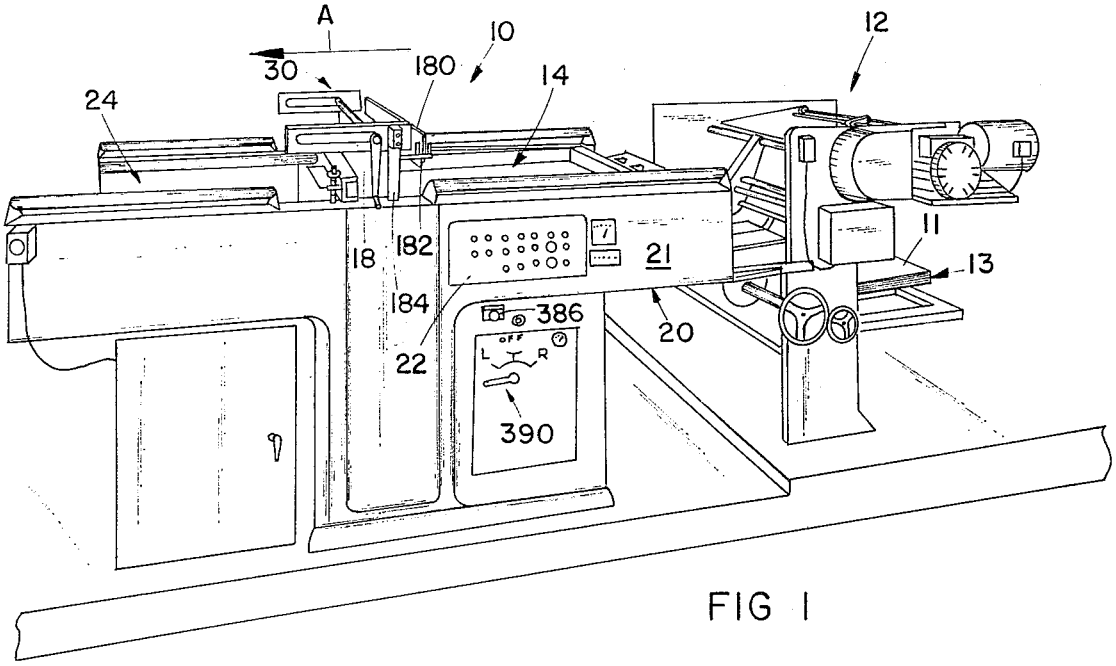
FIG. 1 is a perspective view of the left side of the printing press.

To aid in understanding the placement of the various components of the press embodying the present invention, the direction of motion of the printing stock advancing through the press during a print stroke is indicated by arrow A shown in the various figures. When the movement of printing stock is toward the viewer (out of the plane of the drawing), the arrow is shown as a circle with a center dot. When the motion of the paper is away from the viewer (into the plane of the drawing), the arrow is represented by a circle with cross hairs.

Figure 2:
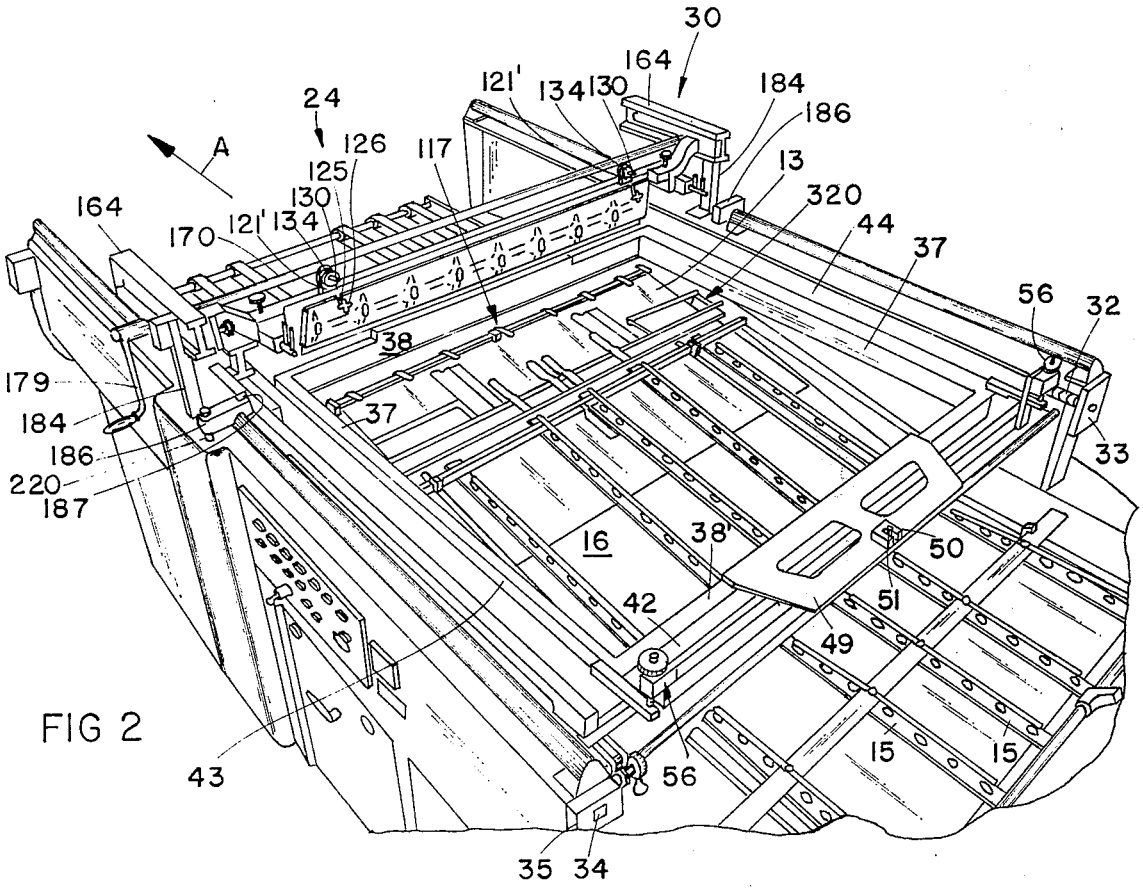
FIG. 2 is an elevated, enlarged fragmentary perspective view of the left front of the printing press.

Referring now to FIG. 1, it is seen that the screen printing press 10 includes a sheet feeding assembly 12 of conventional design and commercially available and operable to remove individual sheets of a stack 13 of printing stock such as sheets 11 of paper. The sheets of printing stock are fed from assembly 12 to an infeed assembly 14 on the press which, as best seen in FIG. 2, includes a plurality of vacuum belts 15 movable over a support surface 16 to grip a sheet of print stock and advance it into a printing area 18 at the center of the press 12. The particular infeed means employed is a commercially available design and is described in greater detail in U.S. Pat. No. 3,120,180 issued on Feb. 4, 1964 and assigned to the present assignee. This patent is incorporated by reference herein. Basically, the infeed means functions to advance individual sheets of paper received from the feeding mechanism 12 into the printing area during each printing cycle.

The press includes a frame 20 having a front vertical wall 21 (FIG. 1) and a rear vertical wall 23 (FIG. 5) and fabricated from suitable support members and covered by plate metal to enclose the drive mechanism therein. Vertical support members 31 (FIG. 5) are positioned to provide support for the bed of the press and components mounted thereto. Extending between the vertical support members at a variety of locations to provide structural support therebetween are a plurality of cross beams 29 (FIG. 5).

As a more detailed description of the components of the press is presented, more specific structural elements of press frame 20 will be pointed out. Mounted to the front panel 21 of frame 20 is a control panel 22 including a plurality of switches, lights and other components for controlling the operation of the press.

Figure 4:
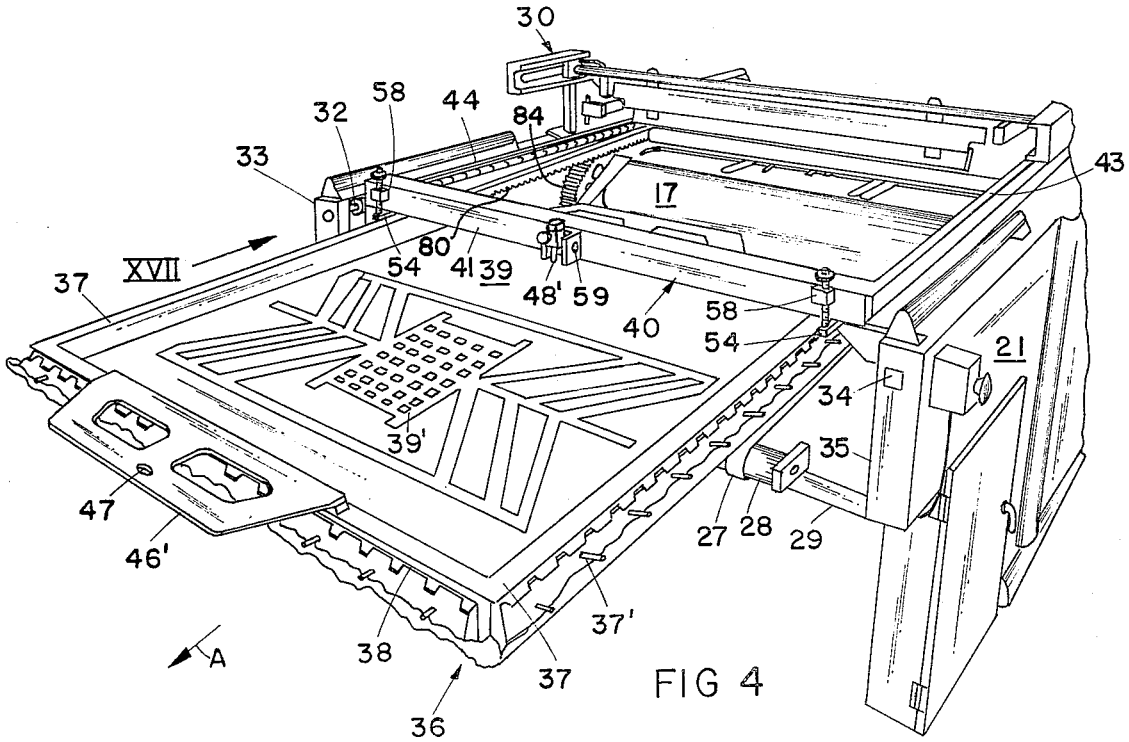
FIG. 4 is a fragmentary, perspective left rear view of the press shown with the screen frame moved almost totally from the carriage permitting access to the components in the printing area of the press.
Figure 5:
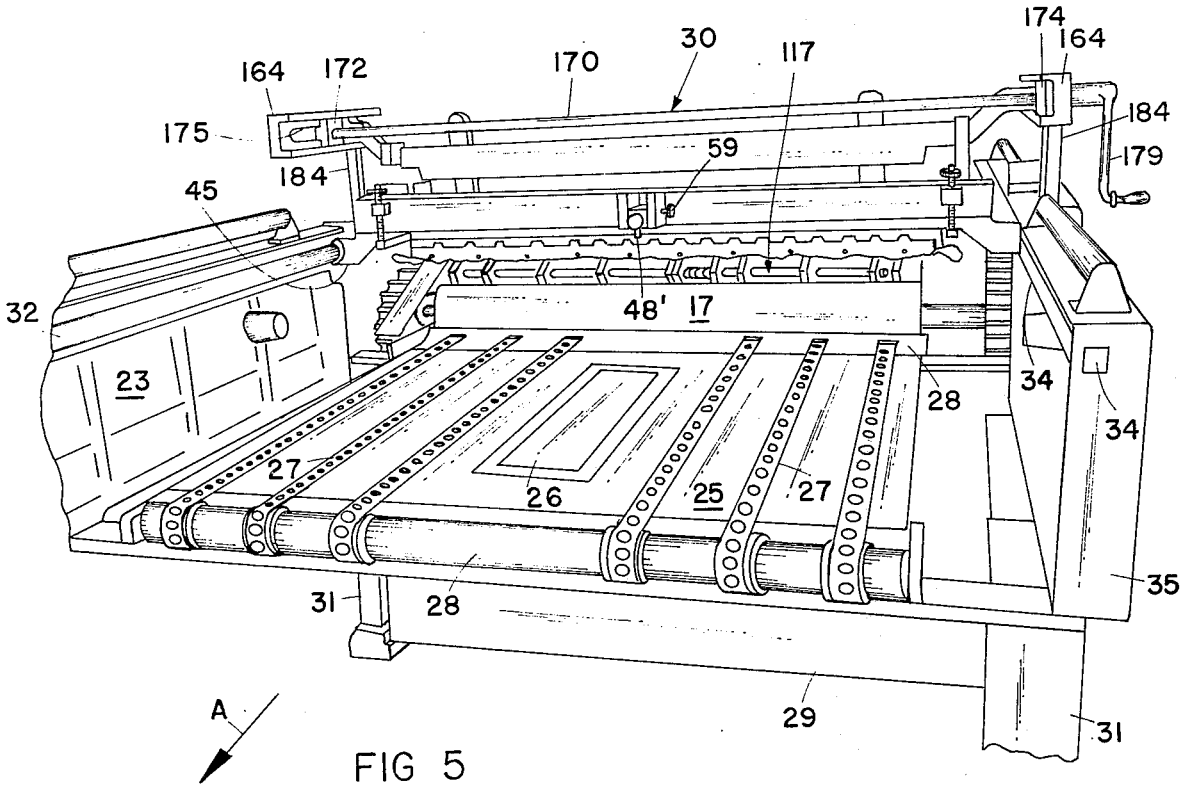
FIG. 5 is a fragmentary perspective view of the rear end of the printing press.

On the side of the press opposite the infeed assembly 14 is the outfeed assembly 24 which includes, as best seen in FIG. 5, a planar support surface 25 including therein a stencil inspection light 26 mounted flush therein. As seen in FIG. 4, light 26 may be employed to inspect the printing pattern 39′ on the stencil screen. A plurality of vacuum advancing belts 27 (FIG. 5) are spaced across the surface of platform 25 for transporting stock received from the print cylinder 17 located in the printing area 18. The vacuum belts 27 are supported on opposite ends by drive rollers 28 for moving the belts to advance the printing stock in the direction of arrow A. The structure of the outfeed is well-known, commercially available, and described in greater detail in the above indentified patent. Spaced above the print cylinder 17, as best seen in FIG. 5, is the movable and adjustable flow coater and squeegee subassembly 30 to be described in detail below.

Extending longitudinally along the right side of the press near the top is a first guide and support rail 32 which, as seen in FIGS. 2–5 and 10, is of circular cross section. As seen in FIGS. 2 and 5, guide rail 32 is supported at opposite ends by means of support mounts 33. Extending longitudinally along the press at the upper left side is a second guide and support rail 34 having a square cross section (FIG. 11) and supported on opposite ends by vertical support brackets 35 as seen in FIGS. 2 and 4.

A screen frame carriage 40, shown in FIGS. 1–5 and in detail in FIGS. 6–10, is slidably and guidably mounted between rails 32 and 34 for support thereon. Carriage 40 comprises front and rear cross members 42 and 41, respectively, and longitudinally extending upper left and right side members 43 and 44, respectively, joining the cross members to form a rectangular screen frame. Conventional angle brackets are employed to secure these frame members.

Figure 11:
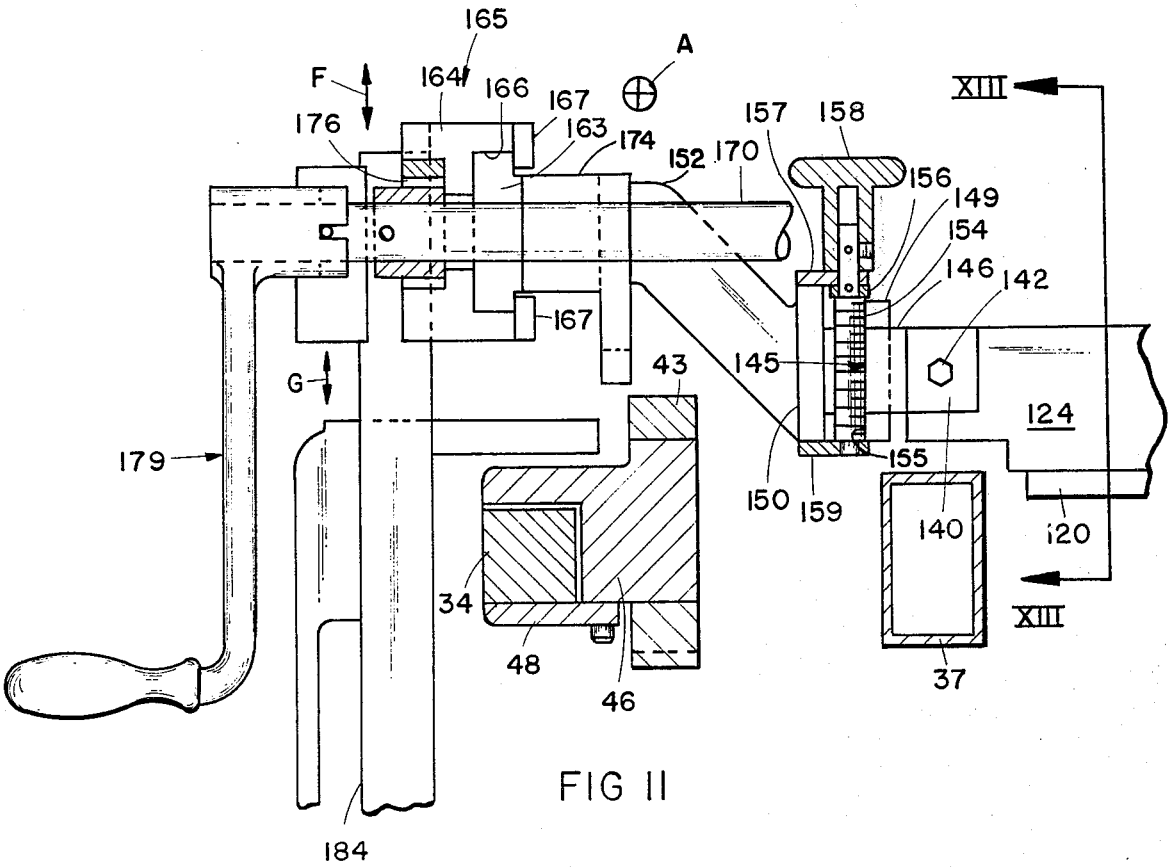
FIG. 11 is an enlarged, fragmentary view partly in cross section of the left front portion of the squeegee and flow coater adjustment mechanism shown in FIGS. 1–4.

Extending outwardly from the right side member 44 at front and rear ends thereof is a collar 45 which spans the circular guide rail 32, as best seen in FIGS. 5 and 10, to provide sliding support for the right side of carriage 40 on rail 32. The left side frame member 43 likewise includes a generally rectangular guide member 46 (FIG. 11) supporting member 43. Member 46 is generally L-shaped and extends over two sides of the square guide 34 as best seen in FIG. 11. A bottom plate 48 bolted to the lower end of member 46 secures the screen carriage in slidable supporting relationship between rails 32 and 34 while permitting a very slight lateral movement of the screen carriage between the rails.

Screen carriage 40 is adapted to receive in aligned locking engagement therewith a printing screen frame 36 which is seen in FIG. 4 in a position partially removed from carriage 40. Frame 36 includes side members 37 coupled to front and rear members 38, 38', respectively, to form a rectangular frame having fasteners 37' spaced around the periphery thereof for tightly securing a mesh printing screen 39 within the frame. Screen 39 is of conventional silk, stainless steel or other construction and includes a printing pattern 39' formed thereon.

Figure 6:
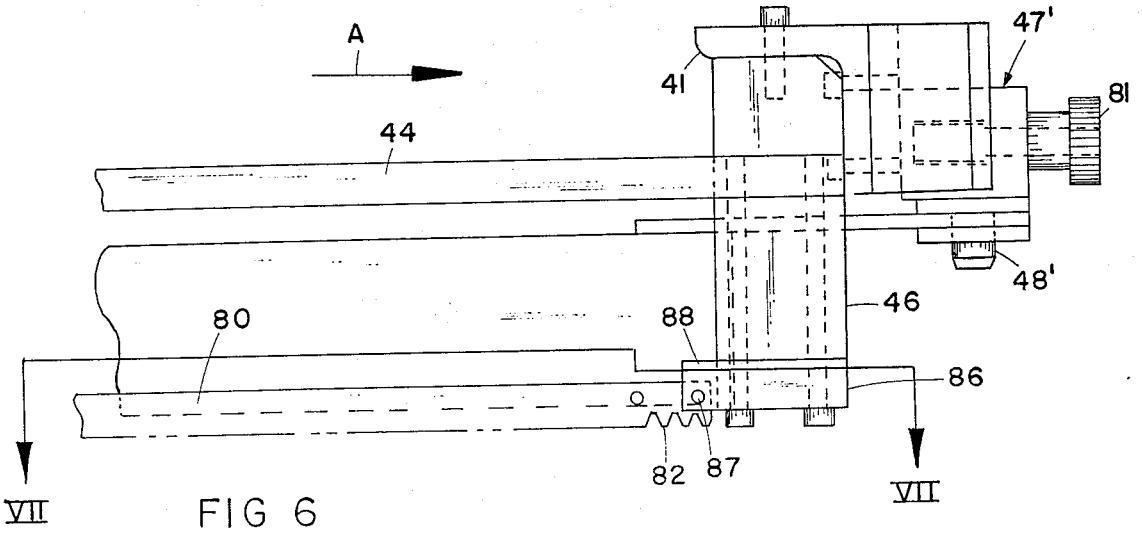
FIG. 6 is an enlarged, fragmentary side elevation of the outer side of the right front portion of the screen frame carriage.

Frame 36 includes a rear locking plate 46' extending from the center of member 38 (FIG. 4) and including an aperture 47 therein which is adapted to be engaged by a vertically movable locking pin 48' (FIGS. 4–6) mounted to support member 41 of the screen carriage. Pin 48' is slidably movable in a vertical direction and is locked in position by a locking screw and knob 59 (FIGS. 4 and 5). As best seen in FIG. 6, pin 48' is mounted to a slide assembly 47' which permits fore and aft adjustment of pin 48' by rotation of adjustment knob 81. By adjusting the position of pin 48' along the direction of movement of printing stock through the press, screen 39 can be adjustably locked in the screen frame carriage at a position to achieve proper registration by fixing the relative position of the printing screen to the printing stock during the printing stroke. Frame 36 includes a front guide and holding member comprising a plate 49 extending from member 38' (FIG. 3) and including a reinforced open ended slot 50 therein for engaging an upwardly extending pin 51 mounted to a bracket 52 secured at the center of the front cross member 42 of the screen carriage 40. Frame 36 is slidably and removably mounted to carriage 40 by the structure now described.

Figure 14:
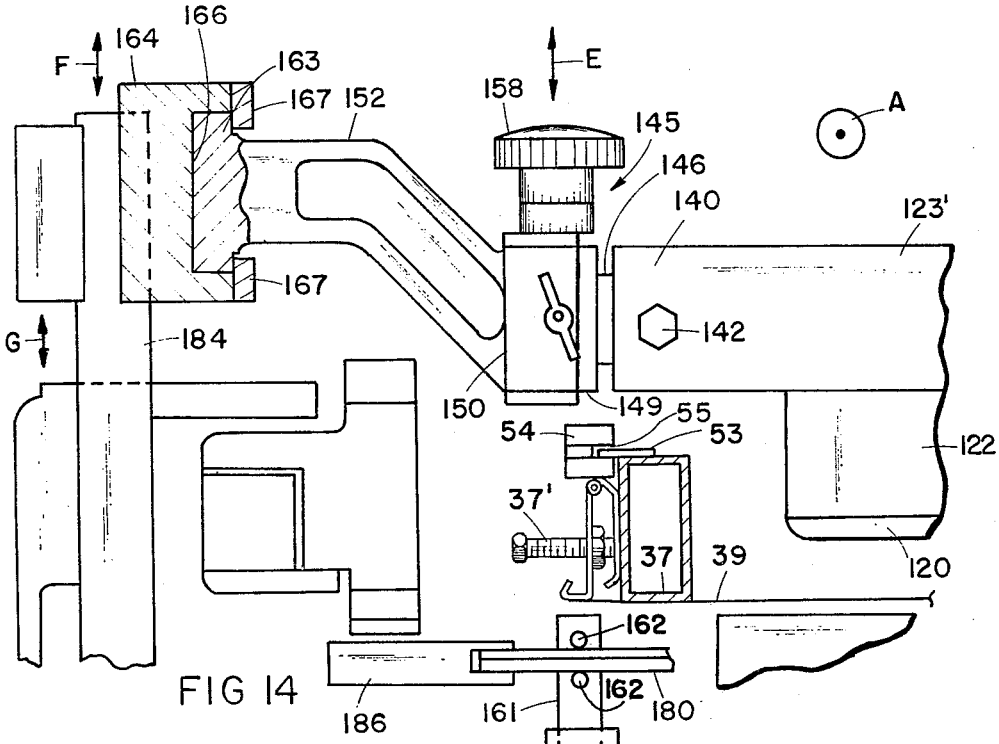
FIG. 14 is an enlarged, fragmentary end view of the right rear end of the squeegee and flow coater adjustment mechanism.
Figure 16:
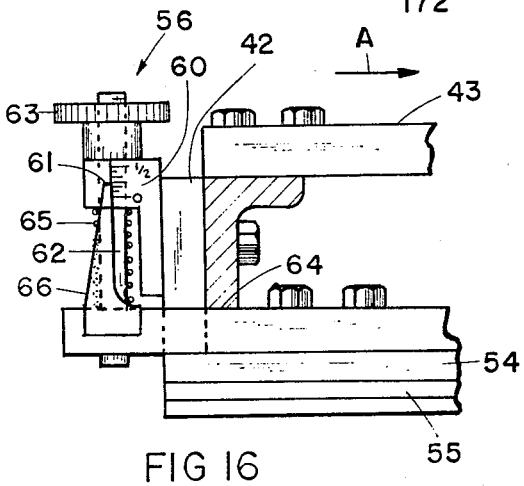
FIG. 16 is an enlarged, fragmentary side elevational view partially in cross section of the adjustment mechanism on the left front corner of the screen frame.
Figure 17:
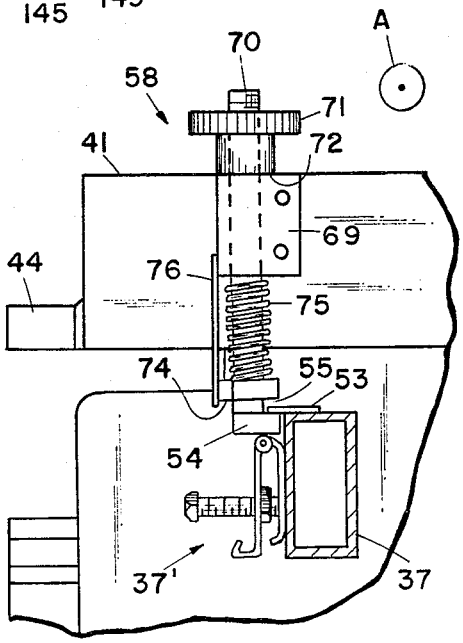
FIG. 17 is an enlarged, fragmentary, rear end elevational view of the adjustment mechanism on the right rear of the screen frame as viewed from angle XVII in FIG. 4.

Extending along the upper surfaces of the opposite side members 37 of the screen frame, as best seen in FIGS. 14 and 17, is an outwardly extending flange 53. Screen frame 36 is slidably supported within the screen frame carriage by means of a pair of longitudinally extending guide rails 54 adjustably coupled to the carriage frame and having elongated guide tracks 55 formed therein and extending their length for receiving flanges 53 on opposite sides of the screen frame as illustrated in FIGS. 3, 14, 16 and 17.

Guide members 54 are suspended from the front and rear screen carriage cross members 42 and 41, respectively, by means of front and rear screen frame adjustment subassemblies 56 and 58, respectively, as best seen in FIGS. 16 and 17 respectively. The front adjustment mechanisms 56 are spaced on opposite corners of the transverse member 42 as seen in FIG. 3.

Each front screen adjustment assembly is bolted to the cross member 42 and includes a collar 60 secured thereto which includes a graduated scale 61 thereon. Bolt 62 includes an adjustment knob 63 threaded at the upper end and extends through collar 60 and is threadably secured to the end of a support plate 64. A spring 65 extends between the lower end of collar 60 and the upper surface of plate 64 to hold collar 60 against the bottom shoulder of adjustment knob 63. A pointer 66 is coupled to plate 64 to indicate its relative vertical position with respect to the graduated scale 61. Plate 64 in turn is bolted to the longitudinal screen frame supporting member 54 such that as adjustment knob 63 is rotated, support rail 54 raises or lowers for adjusting the vertical position of the printing screen with respect to the print cylinder by elevating or lowering the screen frame.

The rear subassemblies 58 likewise each include a mounting boss or collar 69 bolted to cross member 41 of the screen carriage and through which extends a threaded bolt 70 coupled at the lower end to the support rail 54. An adjustment knob 71 is threaded over the top end of bolt 70 as shown. The rear support members 58 are positioned on opposite corners of the rear cross member 41 of the screen carriage as best seen in FIG. 3. A pointer needle 76 is secured to the guide 54 by means of plate 74 and points to a graduated scale etched on the outer surface of each of the collars 69 to indicate the relative position of the rail with respect to the rear frame member 41. A spring 75 extends between collar 69 and bracket 74 to hold the collars 69 against the shoulder 72 of knob 71.

Figure 3:
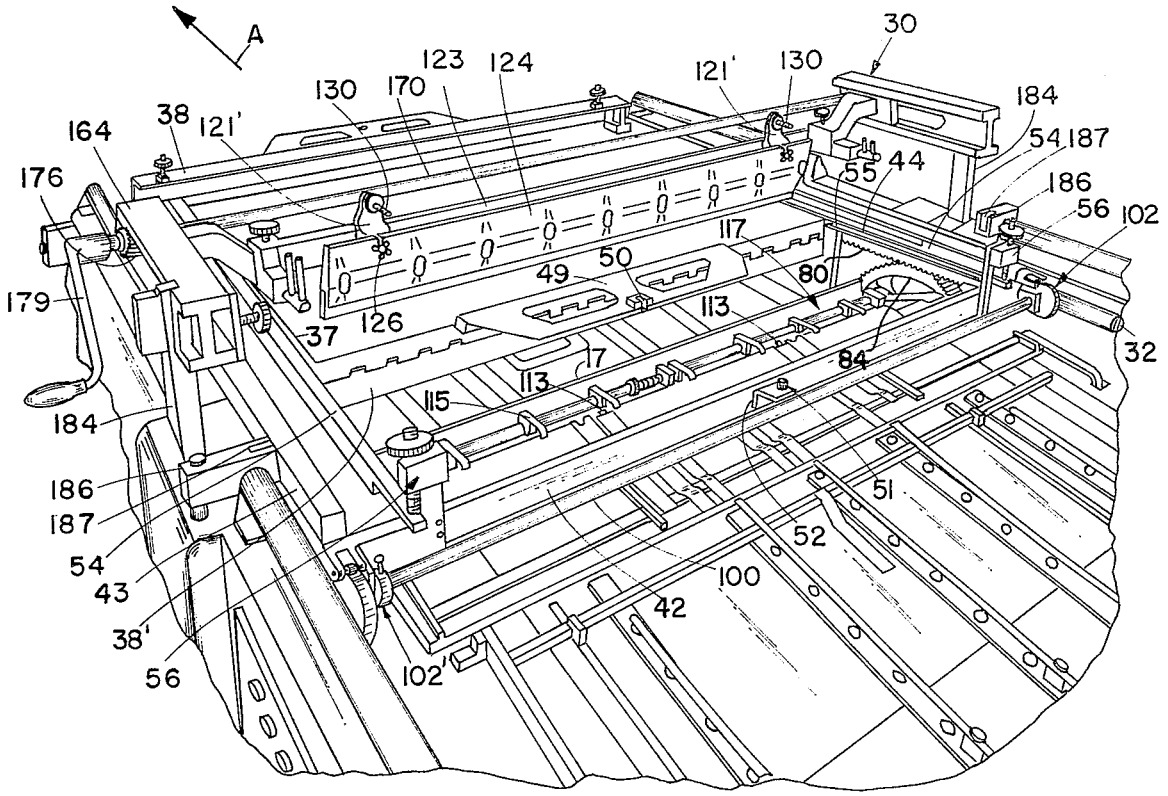
FIG. 3 is an enlarged, fragmentary, perspective left front view of the press shown in FIG. 2 with the screen frame partially removed from the screen frame carriage.

Thus, the screen frame 36 is slidably mounted within the screen carriage 40 and is shown in FIG. 4 in its almost totaly removed position and in FIG. 3 in a partially removed position. In its partially removed position, screen frame 36 is supported by the guide channels 55 of the screen frame in a generally cantilevered fashion with the spaced horizontal internal surfaces of the channels contacting the opposite surfaces of the flanges 53 of the screen frame. The channel is defined by tracks 54 spaced sufficiently apart, as seen in FIGS. 14 and 17, to provide easy sliding movement of the screen frame within the carriage and yet support the screen frame, as seen in FIGS. 3 and 4, when it is partially removed for maintenance. The screen is locked into a registered position within the frame by means of the interengaged notch 50 and pin 51 on the front ends of the screen frame and carriage, respectively, and the locking aperture 47 and pin 48' on the rear of the screen frame and screen carriage respectively. This structure provides relatively easy access to the printing area of the press regardless of the position of the screen carriage since the screen frame can always be slidably moved, either partially or totally from the carriage thereby permitting access to the press from the top. Adjustments 56 and 58 permit vertical adjustment of screen 39 as desired for leveling or other purposes.

The drive mechanism for reciprocating the screen frame carriage 40 during print and return strokes can best be understood by referring to FIGS. 6–10. In this regard, the screen carriage includes a unique decoupling means for decoupling the screen frame from the gear drive as now discussed with reference to these figures.

As described above, the screen carriage 40 comprises cross members 41, 42 coupled together by upper longitudinal support members 43 and 44. The screen frame is slidably carried by the longitudinal guides 54 adjustably mounted to the end supports by the adjustment means previously described. The guides 54 are spaced inwardly somewhat from the side rails 43, 44 as best seen in FIG. 3. This permits the mounting of the disengageable drive means for the cariage below the side rails.

Referring to FIGS. 6–8, each side of carriage 40 includes a lower rail 80 forming a rack having downwardly depending gear teeth 82 which engage a toothed drive gear 84 mounted on drive shaft 85. Members 80 extend longitudinally along the length of the carriage under upper side members 43 and 44. Each of the rearward ends of racks 80 is pivotally coupled to a bracket 86 coupled to member 46 (FIG. 6). As best seen in FIGS. 6 and 7, a pivot pin 87 pivotally couples the end of member 80 between forks 88 of bracket 86.

Figure 9:
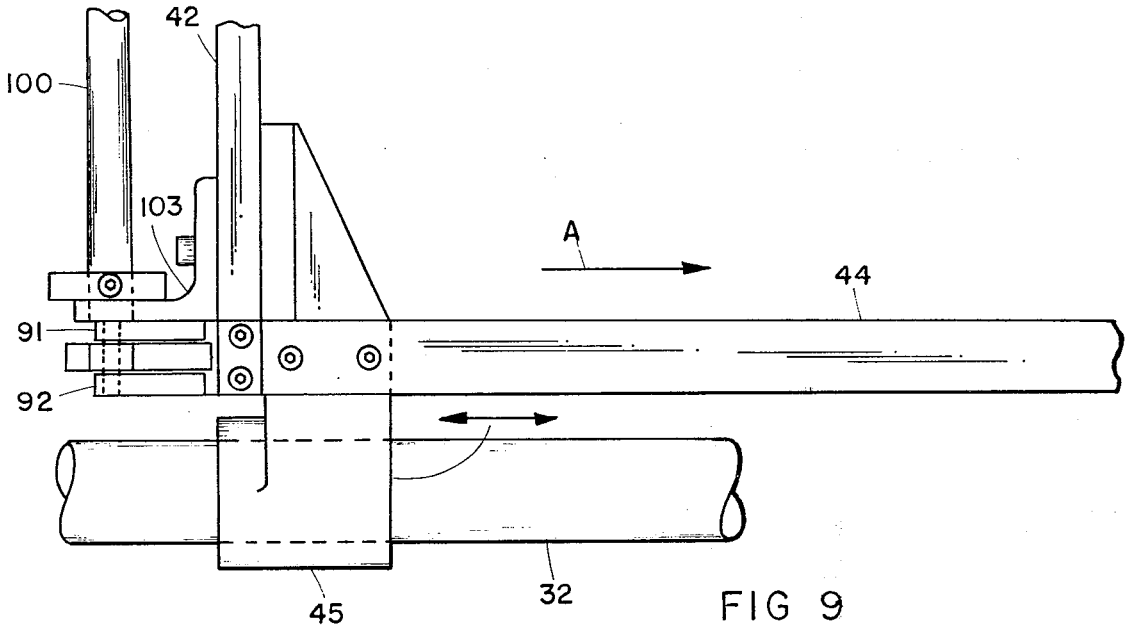
FIG. 9 is a fragmentary plan view of the structure shown in FIG. 8.

The front end of each of the racks 80 is coupled to a cam follower holder 90 which, as best seen in FIGS. 9 and 10, comprises a pair of spaced arms 91 and 92 with a rotating cam follower wheel 93 rotatably mounted on an axle 94 extending therebetween. A cam 95 has a curvilinear outer surface 96 which engages the lower portion of the roller cam follower 93 and, as seen in FIG. 8, has an increasing radius around the periphery therof. Cam 95 is fixedly mounted to rotating shaft 100 in turn coupled to frame member 42 by mounting arm 103. Shaft 100 is rotatably supported on opposite ends by arm 103 to permit rotation therof achieved by a handle 97 on arm 98 extending from a collar 99 fixedly attached to shaft 100. When the cam 95 is rotated clockwise in FIG. 8 by means of handle 97, the increased radius portion of the cam raises the front end of racks 80 which pivot at rear ends about pins 87 in a direction indicated by arrow B of FIG. 8. This raises the racks 80 off of the drive gears 84 on opposite sides of the press thereby disengaging the carriage from the drive means.

This raising and lowering mechanism 102, illustrated in FIGS. 7–11, is duplicated with an identical unit 102' on the opposite side of the press as best seen in FIG. 3. Suitable locking means can be provided to hold cam 95 in the rack raising position (i.e., with the handle 98 pointed generally upwardly). Cam 95 also includes a notched aperture 95' which, as seen in FIG. 8, locks rack 80 in a downward position during printing operation.

With the carriage disengaged, paper can be supplied through the press by the infeed means and the sheet feed and registration of the printing stock can be checked without the reciprocating carriage interfering with the inspection or adjustments. When this feature is combined with the novel screen mounting feature which permits sliding of the screen either partially or totally out of the carriage, and with the unique squeegee and flow coating mounting mechanism described below, the entire printing area around print cylinder 17 may be easily opened for inspection, maintenance or repairs without disassembling the press.

When the carriage racks 80 are in a raised position, a notched plate 104 mounted on each of the racks 80 (one shown in FIG. 8) will raise and if desired, the carriage can be locked in position by aligning a notch 105 in bracket 104 with a pin 106 positioned in the fixed guide rails 32 or 34. When it is desired to reengage the rack, cam 95 is rotated into the lower position as shown in FIG. 8. Plate 104 includes a downwardly depending, single tooth 107 adapted to engage a single notch 109 in a gear ring 108 on the outer periphery of gear 84 to assure positive alignment between the drive gear 84 and the screen carriage 40 in the proper timing relationship. This structure provides indexing means between the drive means and screen carriage.

The drive shaft 85 which supports drive gears 84 on opposite ends of the shaft to engage the racks 80 on opposite sides of the frame, as best seen in FIGS. 3 and 4, is interconnected with the printing cylinder drive mechanism which is sustantially identical to that shown in the above identified patent and now breifly described.

Basically, the drive mechanism comprises an electrical motor having a pair of crank arms coupling the rotating shaft of the motor through a drive gear system for reciprocating shaft 85 to which the print cylinder 17 is mounted through print and return strokes in forward and reverse directions as indicated by arrow C in FIG. 8 and spanning an arc of approximately 300°. As the print cylinder advances to advance the sheet stock in contact therewith, the screen carriage and printing screen thereon simultaneously advance to form a print on the stock positioned between the printing screen and the cylinder in a conventional manner.

The print cylinder includes a notched opening 117, as best seen in FIG. 3, in which is located a plurality of gripping fingers 115 for receiving and holding printing stock from the infeed means 14 at the initiation of the printing stroke. As best seen also in FIG. 3, adjacent gripping fingers 115 are a plurality of spaced stop members 113 which provide the positive longitudinal registration of the printing stock as it is fed into the printing area and subsequently gripped by fingers 115. The detailed description of the print cylinder construction together with the gripping finger actuation and stop positioning is set forth in the above identified patent and will not be repeated here other than to note that this arrangement provides accurate longitudinal registration of the printing stock at the initiation of each print stroke. As the print cylinder rotates through approximately 90°, the gripping fingers release the print stock and permit it to advance onto the outfeed table 24.

Having described the unique screen carriage and drive means therefor, a description of the improved squeegee and flow coater mechanism 30, as seen in FIGS. 1–4 and shown in greater detail in FIGS. 11–15, follows. The squeegee construction comprises a squeegee blade 120 mounted between a backing plate 122 and a frame 124 (FIG. 13). Plate 122 and frame 124 are bolted to a longitudinal support bracket 121 in turn pivoted to longitudinal arm 123 as seen in FIG. 13. Frame 124 includes a pair of notches 125 (FIGS. 2 and 3) which receive securing bolts having thumb wheel heads 126 for detachably mounting the squeegee subassembly to the bracket 121 as seen in FIGS. 3 and 13. As seen in FIGS. 11 and 14 which show the opposite ends of the squeegee subassembly and FIG. 13, cross member 123' is detachably secured to a forked bracket 140 (FIGS. 11–14) by a bolt 142. Bracket 140 in turn is secured to a slide assembly 150 for the squeegee subassembly and described in greater detail below.

The squeegee blade can be adjusted through an angle of approximately 45° by the pivot mechanism best seen in FIG. 13. As seen in this figure, the lower end of support bracket 121 to which the squeegee is mounted is pivotally mounted to longitudinal arm 123 by means of a pivot pin 128. Member 123 is notched at 127 to permit member 121 to pivot to the extreme position shown in FIG. 13. To adjust the squeegee at a desired angle, a pair of spaced threaded rods 130 are pivotally mounted to extensions 121' of member 121 by pivot pins 131. Rods 130 extend through apertures 132 in member 123 which is spanned by a threaded nut 134 on rod 130 at the rear surface of member 123 and a knurled threaded knob 135 on rod 130 at the front surface of member 123.

By adjusting lock nut 134 and adjustment knob 135, a desired tilt (i.e., angle) of squeegee blade 120 to the screen can be achieved. Additionally, the amount (i.e., length) of the flexible squeegee blade extending below backing plate 122 can be adjusted to provide stiffer or more flexible squeegee action by means of adjustment bolts 136 which, as seen in FIG. 13, are threaded into plate 122 to clamp the blade between the lower portion 124' of frame 124 and plate 122.

Thus, by providing the adjustment means 135 and 136, both the angle and the extension of the squeegee blade can be controlled with the angle being adjustable as indicated by arrow D in FIG. 13. This permits the adjustment of the thickness of the actual printing on the print stock due to the amount of ink being forced through the printing screen by the squeegee. Additionally however, the squeegee is adjustable both vertically and longitudinally with respect to the crown of print cylinder 17. The mechanism for providing such adjustments is now described.

Figure 15:
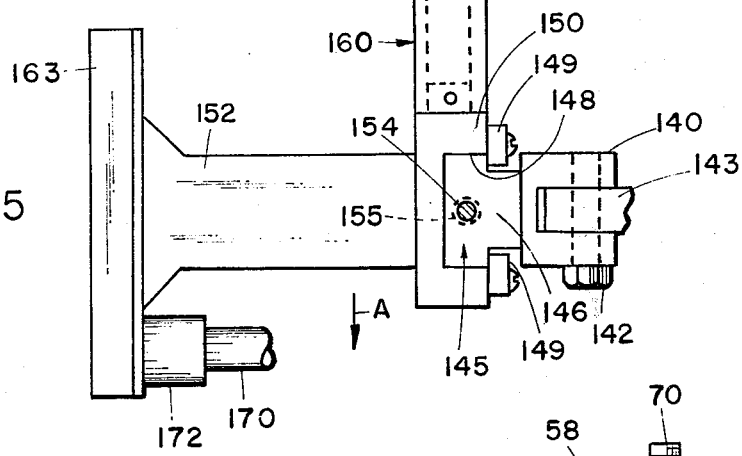
FIG. 15 is a partial plan view of the apparatus shown in FIG. 14.

The squeegee cross arm 123' is detachably bolted at each end to a first or vertical slide assembly 145 by means of bolt 142 and flange 140 (FIGS. 11, 14 and 15). Flange 140 is secured to a slide member 146 slidably fitted within a generally U-shaped guide channel 148 of guide bracket 150 integrally coupled to an end of support arm 152. The left side support arm and structure is shown in FIG. 11 and is identical to the right side support arm and structure, as shown in FIGS. 14 and 15, except for the drive means associated with the left side and described below in conjunction with FIGS. 11 and 12. Slide 146 is held in channel 148 by a pair of keeper plates 149 and is adjustably vertically movable within the channel 148 in the direction indicated by arrow E in FIG. 14 to provide a fine vertical adjustment for the squeegee subassembly. Adjustment is accomplished by means of a threaded screw 154 which, as best seen in FIG. 11, is threadably fitted within a vertically extending threaded aperture 155 in slide 146. Screw 154 is vertically fixed and attached to bracket 150 by a collar 156, as best seen in FIG. 11, attached to the shank of the screw and in contact with upper plate 157 on bracket 150 and through which the shank of the screw extends. As screw 154 is rotated by knob 158 attached thereto, slide 146 moves vertically for adjusting the squeegee height. Lower plate 159 provides support for the lower end of screw 154.

In addition, guide bracket 150 includes a rearwardly extending arm 160, as best seen in FIG. 15, and extension 161 with a pair of spaced vertical posts 162 for releasably supporting therebetween a flow coater support bar 180 with a flow coater blade 182 depending downwardly therefrom (FIGS. 1 and 13).

To provide vertical motion to the squeegee and flow coater from a lowered operating position to an intermediate raised position and finally to a high rise position, as illustrated in FIGS. 1–5, as well as to provide longitudinal movement for adjustment and/or servicing, the press includes a second or horizontal slide assembly 165 (FIG. 11) associated with each end of the squeegee support mechanism and now described.

Figure 12:
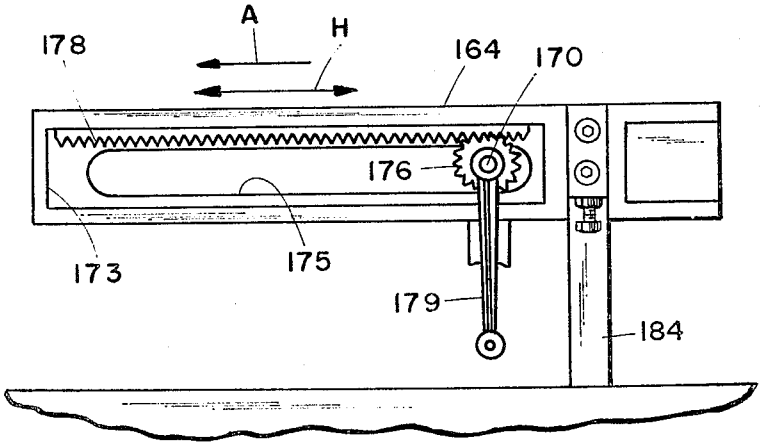
FIG. 12 is a fragmentary, left side elevational view of the structure shown in FIG. 11.

Assembly 165 comprises a pair of guide brackets 164 (FIGS. 11, 12 and 14) shaped to define an elongated U-shaped guide channel 166 into which are slidably fitted slide members 163 at the outer ends of arms 152. Slides 163 are elongated, generally rectangular members, as seen in FIGS. 14 and 15, which are retained in track or guide 166 by retainer bars 167. Extending between the slides 163, as best seen in FIGS. 5, 11 and 15, is a rotatable shaft 170 extending through a bearing block 172 mounted to the right side slide and coupled at the opposite end to a bearing block 174 on the left side slide. The left side guide bracket includes an elongated aperture 175 (FIG. 12) formed therethrough. Shaft 170 extends through aperture 175 and includes a gear 176 mounted thereon which is aligned with and engages a rack 178 mounted to the inside upper edge of a recess 173 formed in the outer surface of left side bracket 164 as best seen in FIG. 12. Gear 176 is securely attached to shaft 170 which extends further outwardly therefrom and includes a crank handle and arm mechanism 179 as best seen in FIGS. 11 and 12.

The right side guide member 164 of the press is identical to the left side guide, and shaft 170 includes a gear substantially identical to gear 176 as well as a rack assembly mounted to the upper edge of an aperture in guide bracket 164 on the right side of the press. Thus, as the rotating interconnecting shaft 170 is rotated via crank arm 179, opposite sides of the squeegee horizontal slides 163 are moved longitudinally in a direction indicated by arrows H in FIG. 12 along rack guides 164 such that the squeegee 120 and flow coater 182 can be moved upstream and away from the printing area 18 when in the high rise position to permit inspection and servicing on the press. If the squeegee is in a normally lowered position, crank arm 179 can be used to adjust the squeegee blade longitudinally in relation to the crown of print cylinder 17. The length of the guide bracket 164 is sufficient to allow the squeegee and flow coater subassemblies to be moved completely out of the way of the printing area. Thus, the squeegee blade can be adjusted to a position either immediately above the crown or upstream or downstream of the crown as desired to effect the type of printing on the print stock that is required. Specifically, the positioning of the squeegee upstream of the cylinder crown causes a richer coat of ink, but of lesser quality, while positioning of the squeegee downstream of the crown causes a thinner ink coat, but of better detail quality. Squeegee positions between the two will result in varying compromise results.

It is seen, therefore, that the squeegee is fully adjustable in angular, vertical and longitudinal directions and is easily removable if necessary by removing bolts 142 holding the squeegee frame and angular adjustment assembly to the slide assembly 145. By providing this unique structure, therefore, adjustments to the squeegee positioning with respect to the print cylinder may be made very rapidly without losing significant down time of the press frequently required when conventional screen presses are employed. In addition however, the mechanism permits easy inspection and when combined with the unique carriage assembly and moved to its most forward position, as represented in FIG. 3, the squeegee and flow coater assemblies are out of the printing area and the printing screen likewise is removed from the carriage permitting access directly to the print cylinder and its asssociated mechanism as well as the registration means for the print stock.

Not only are the components moved out of the way, it is still possible with the components in this position to dry run paper into and out of the press checking the operation of the paper feed mechanism without actually printing on the paper. Additionally, by providing the longitudinal adjustment means for the squeegee and flow coater assemblies, the squeegee need not be removed from the press and any residual ink from previous printing will drip onto the screen since by privided the longitudinal adjustment of the squeegee it will still be positioned over the screen when the screen is partially removed from the frame as seen in FIG. 3.

To provide movement of the squeegee and flow coater between a lowered, operating position and the high rise position illustrated, the slide guides 164 are mounted to vertically movable posts 184 extending upwardly from opposite sides of the press and movable, as indicated by arrows F in FIGS. 11 and 14, between a high rise position, illustrated in FIGS. 1–5, and a lowered, operative position for screen printing. Additionally, the posts 184 are driven an incremental vertical distance, indicated by arrows G in FIGS. 11 and 14, to raise and lower the squeegee during return and print strokes respectively. A discussion of the mechanism employed to accomplish this motion is now discussed with reference to FIGS. 18–21.

Figure 21:
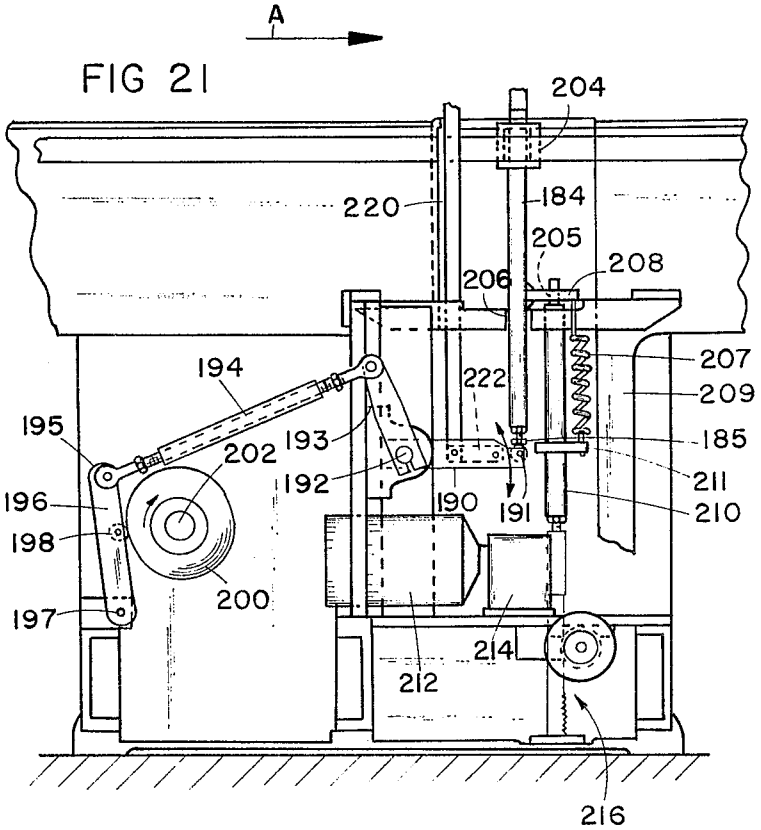
FIG. 21 is a side elevational view of the mechanism employed for raising and lowering the squeegee and flow coater assembly during return and print strokes respectively.

It is noted here that the drive means for posts 184 supporting the squeegee mechanism is similar to that described in the above identified patent and which is shown in FIG. 21 of the present application. Referring now to FIG. 21 showing one of the identical drive means employed on opposite sides of the press, it is seen that post 184 is slidably mounted within vertically spaced sleeves 204 and 206 suitably mounted on the frame of the press and includes a cam follower plate 185 at its lower end which engages a roller cam 191 at the end of a pivot arm 190. Each of the posts 184 is biased against the roller cam 191 by means of a bracket 208 extending from the posts and biased in a downward direction by means of a spring interconnecting bracket 208 to the lower spring bracket 211 mounted to member 210 as seen in FIG. 21.

Arm 190 in turn is rigidly coupled to a pivot shaft 192 driven by a crank arm 193 coupled to interconnecting link 194 coupling arm 193 to the end 195 of cam follower arm 196. Arm 196 is pivotally mounted to the frame at end 197 and includes a roller follower 198 engaging a cam 200 mounted on rotating shaft 202 which is intercoupled with the cylinder drive shaft of the press by conventional gearing means as disclosed in the above identified patent.

As arm 190 reciprocates up and down during each print and return cycle, vertical posts 184 will be moved an incremental distance as indicated by arrow G in FIG. 14. The distance is sufficient to lift the squeegee off the printing screen during the return stroke and lower the squeegee into operative engagement with the printing screen during the successive print stroke to force ink through the screen onto the printing stock. Extending through a sleeve bushing 205 in bracket 208 is the end of a vertical drive arm 210 which is driven by a motor 212 via a gear reduction box 214 and rack and gear assembly 216 as shown in FIG. 21 and as described in greater detail in the above identified patent. Vertical arm 210 provides for automatic raising of posts 184 upon the actuation of motor 212 to achieve the high rise positioning of the squeegee and flow coater assembly as indicated by arrow F in FIG. 14 and shown in FIGS. 1–5. Spring 207 is selected to provide a suitable biasing force for the posts against the roller 191 on pivot arm 190. During printing, the lower end of spring 207 is held in a fixed position by the worm gear coupling to arm 210 which resists movement of the arm.

Also coupled to pivot arm 190 is a flow coater drive arm 220 interconnected to arm 190 by means of a conventional linkage assembly 222 to permit a 180° phase displacement between the vertical motion of members 184 and 220. Thus, as the squeegee support raises during the return stroke, the flow coater supports 220, also positioned at opposite sides of the press, will lower to lower flow coater 182 into operative position.

Coupled to the end of flow coater drive arms 220, as seen in FIG. 2, are a pair of flow coater support yokes 186 of conventional design and disclosed and described in greater detail in the above identified patent. Basically, the flow coater bar 180 rests within a notch 187 of member 186 such that as the shafts 220 raise and lower during press operation, the flow coater will similarly be raised and lowered. The vertical support posts and extension arms 162 and 161, respectively, extending from the squeegee guide 150 (FIG. 15) are positioned under and in alignment with the flow coater such that when the squeegee is raised to a high lift position by the upward vertical motion of posts 184, the flow coater will be lifted out of the mounting brackets 186 and carried along with the squeegee assembly to a high rise position and moved longitudinally with the squeegee when arm 179 is rotated.

Figure 20:
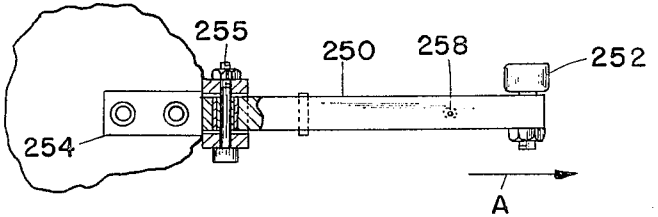
FIG. 20 is a sectional view of a portion of the structure shown in FIG. 18 and taken along section lines XX—XX of FIG. 18.
Figure 18:
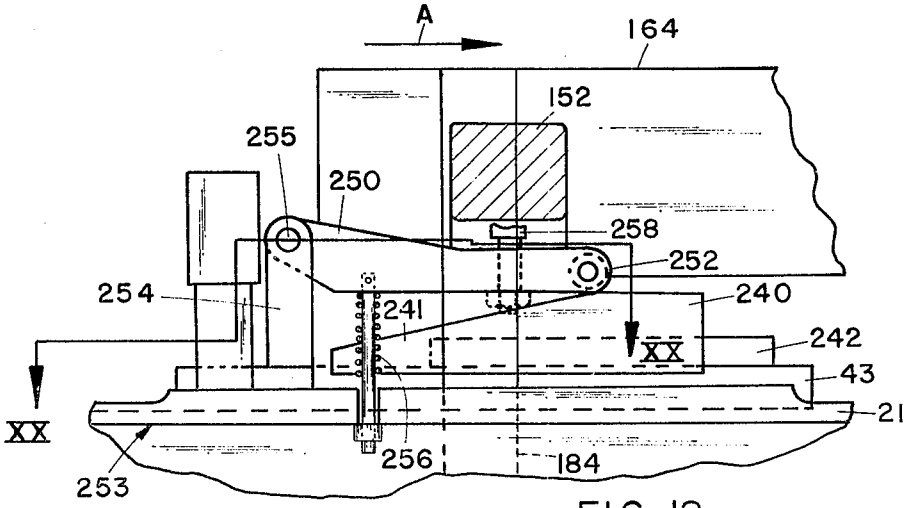
FIG. 18 is an enlarged, fragmentary side elevational view partly in cross section of a portion of the squeegee drive mechanism on the right side of the press.
Figure 19:
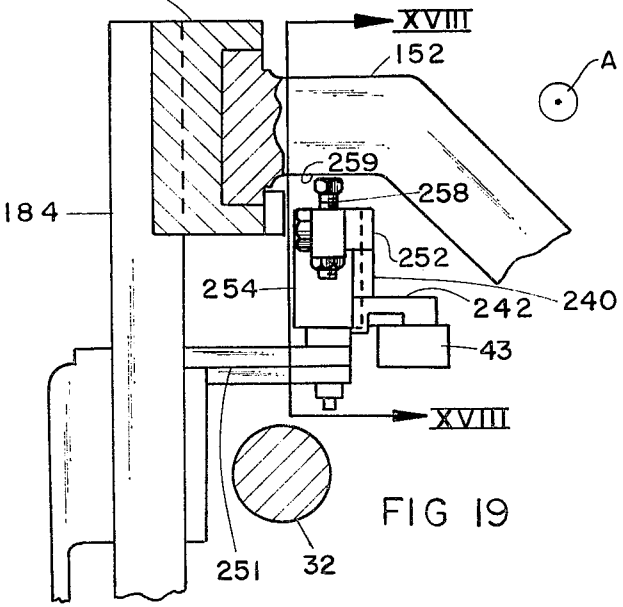
FIG. 19 is a fragmentary right side elevation partly in cross section of the structure shown in FIG. 18.

In earlier presses, the squeegee was lowered just before the print stroke by a cam acting through interconnecting mechanism. With such structure, it was learned that the dropping squeegee tended to bounce or chatter, tending to damage the screen and/or force excessive ink onto the printing stock. Sometimes it caused smearing of the printed copy resulting therefrom. In order to provide for a smooth lowering of the squeegee in a controlled fashion to the printing screen at the initiation of the print stroke, therefore, a positive squeegee drop cam arrangement, as seen in FIGS. 18–20, has been provided and will now be described. In the figures, the mechanism for the left side of the press is shown, it being understood that the right side includes an assembly substantially identical.

The squeegee lowering mechanism comprises a tapered cam block 240 positioned near the leading (rear) edge of each of the upper rails (43, 44) of the carriage assembly. Block 240 includes and is mounted to the rear edge of the left upper support rail 43 of the carriage by means of a bracket 242. Cam 240 includes an inclined surface 241 on which rides a cam follower arm 250 having a roller follower 252 at one end and engaging inclined surface 241 and which is pivotally mounted at the opposite end to a mounting boss 254 by means of pivot pin 255. Boss 254 is mounted to the frame member 253 near the middle of the press.

A bias spring and supporting shaft 256 urges the pivot arm 250 upwardly and an adjustable stop 258 mounted on arm 250 engages the undersurface 259 of the squeegee support arm 152. With the screen carriage in the position shown in FIG. 18 which corresponds to the beginning of a printing stroke, stop 258 holds the squeegee in a slightly elevated position. As the print stroke is initiated by the carriage and print cylinder drive mechanism, the carriage frame moves in the direction of arrow A and the roller follower 252 rolls down inclined ramp 241 allowing spring 207 (FIG. 21) which counteracts the relatively light bias of spring 256, to lower the squeegee into engagement with the printing screen in a controlled and linear fashion preventing chatter or bouncing of the squeegee on the screen frame.

In addition of the screen carriage and squeegee related improvements described, the screen printing press of the present invention further includes adjustable side registration means for permitting adjustments of the side registry of the printing stock as it is fed into the press during a printing run without requiring shut down of the press. The novel structure employed to accomplish both coarse and fine adjustments for side registration of the print stock is shown in FIGS. 22–27 now described.

Figure 22:
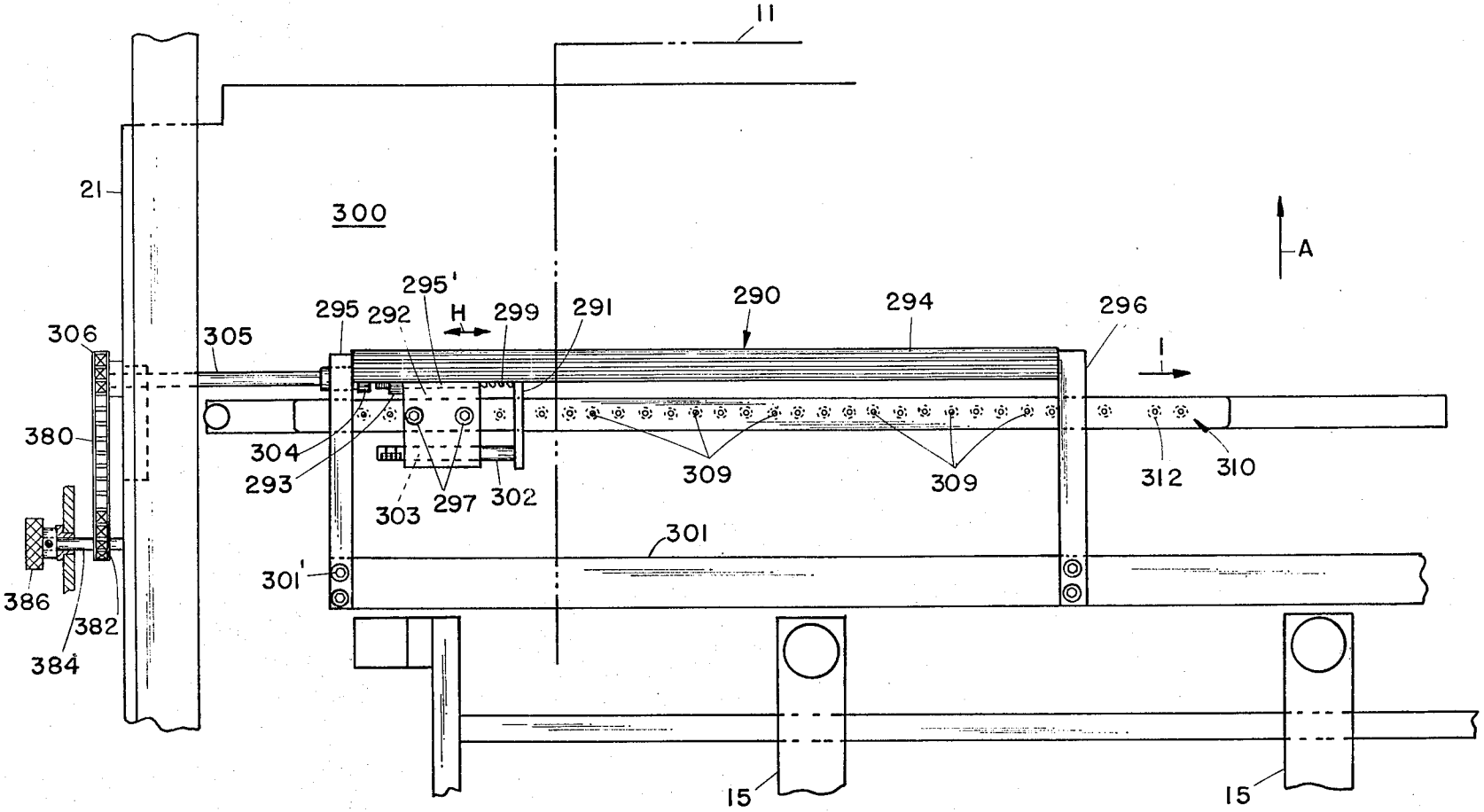
FIG. 22 is a fragmentary plan view of the left side of the printing area showing the left portion of one embodiment of the side registration means for the printing stock.
Figure 23:
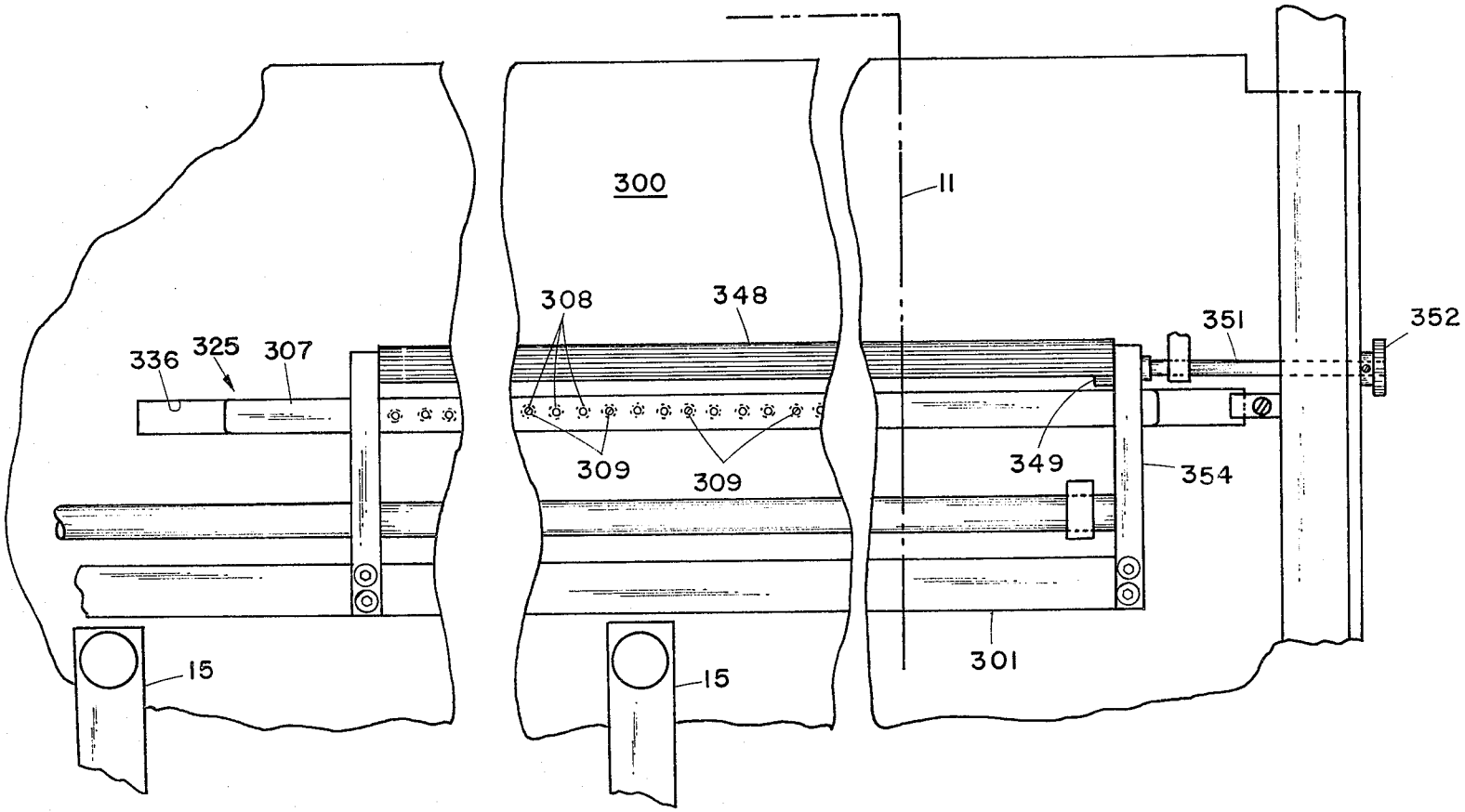
FIG. 23 is a fragmentary plan view of the right side of the printing station showing the opposite end of the side registration means thereon.

The adjustable side registration means is positioned in advance of the printing area 18 and is divided into left and right sections 290 and 325 as seen in FIGS. 22 and 23 respectively. A sheet of printing stock 11 is shown in phantom form in FIGS. 22 and 23 to illustrate the positioning of the edges of the stock with respect to the side registration mechanism. The relative positioning of the registration means on the right side is shown in FIG. 2.

Referring now to FIG. 22, it is seen that the left side of the registration means comprises a pusher plate 291 movably positioned with respect to a mounting block 292 as indicated to provide a fine adjustment of the pusher mechanism as indicated by arrow H in FIG. 22. Adjustment of plate 291 which contacts an edge of print stock 11 during side registration, as described below, is accomplished by means of an elongated gear 294 which is mounted between support arms 295 and 296 in a rotating fashion. The opposite ends of these arms are mounted to bar 301 spaced above a bed plate 300 of the press by means of bolts 301'.

Block 292 is in turn mounted to a sliding tubular sleeve 310 having a plurality of threaded apertures 312 therein by means of bolts 297 extending through block 292 and into a pair of the equally spaced threaded apertures 312. Tubular member 310, as will be discussed below, is moved during a side registration step by drive means, disclosed below, for moving the member and plate 291 toward the right as indicated by arrow I in FIG. 22. To provide coarse adjustment of the positioning of plate 291 with respect to printing stock, block 292 is shifted incrementally into the desired pair of apertures 312.

To provide fine adjustment of the pusher plate 291 for registration during running of the press, gear 294 is coupled to a mating, internally threaded gear 293 on the end of a threaded shaft 295'. Shaft 295' extends through block 292 and is fixedly mounted to plate 291 with a bias spring 299 being positioned between plate 291 and block 292. The opposite end of plate 291 is supported in slidable engagement with respect to block 292 by means of a shaft 302 which slidably extends through an aperture 303 in block 292. A drive gear 304 is coupled to an adjustment shaft 305 extending outwardly from the left side 21 of the press and terminating in a sprocket 306 to permit rotation of drive gear 304. A chain 380 couples sprocket 306 to a drive sprocket 382 mounted on a rotatable jack shaft 384 extending from the press and terminating in an external adjustment knob 386 (FIGS. 1 and 22) on the operator's side of the press. Rotation of sprocket 306 in turn rotates elongated gear 294 subsequently rotatiang the gear 293 on threaded shaft 295'. This causes plate 291 to move relative to block 292 (arrow II).

Thus, the position of edge guide plate 291 can be adjusted in a coarse fashion by employing apertures 312 or in a fine fashion via the external adjustment. The movement of the side registration means, as indicated by arrow I, is a fixed distance so that the distance the print stock will be shifted to the right for side registration is determined in part by the coarse and fine adjustments to the position of plate 291 used as the reference edge. It is noted here that the coarse adjustment permits use of the press for a variety of sizes including the new sheet stock which is 32 by 43 inches. Gear 294 is sufficiently long to permit the motion of block 292 relative to gear 294 during the side registration step as well as provide continuous engagement with gear 293 as block 292 is moved for coarse adjustment.

The tubular member 310 with the plurality of apertures 312 is coupled to a source of vacuum by conventional means such that the left side registration, shown in FIGS. 2, 22, tends to grip the sheet of print stock 13 from the underside through the use of orificed vacuum bar 310. As the vacuum bar shifts position together with the plate 291, the mechanism of FIG. 22 tends to pull and push the print stock to the right for side registration.

The right side registration apparatus 325 (FIG. 23) also includes a tubular vacuum bar 307 which has a plurality of threaded apertures 308. Vacuum bars 310 and 307 are interconnected and driven to the right by means of an interconnecting rod and spring returned by the mechanism shown in FIGS. 26 and 27 used for both embodiments and described below.

To permit interchangeability of the registration means such that registration can be accomplished by movement of the print stock to the left or to the right, the right side registration apparatus includes a pair of hold down arms 354. Arms 354 are bolted at one end to bar 301 and rotatably support an elongated gear 348 extending between the opposite ends therof. A gear 349 meshes with the right end of gear 348 and is supported on shaft 351 extending to sprocket 352. Sprocket 352 is also coupled to a sprocket on the jack shaft 384 by a chain (not shown).

In the embodiment shown in FIGS. 22 and 23, plate 291 forms the reference for side registration and pushes the print stock a fixed distance, which is adjustable by adjusting plate 291, to achieve side registration. In this embodiment, vacuum bars 307 and 310 are not employed. Thus, a three-way valve 390 (FIG. 1), employed to selectivley couple the vacuum bars to a vacuum source, is moved to its off position.

Figure 24:
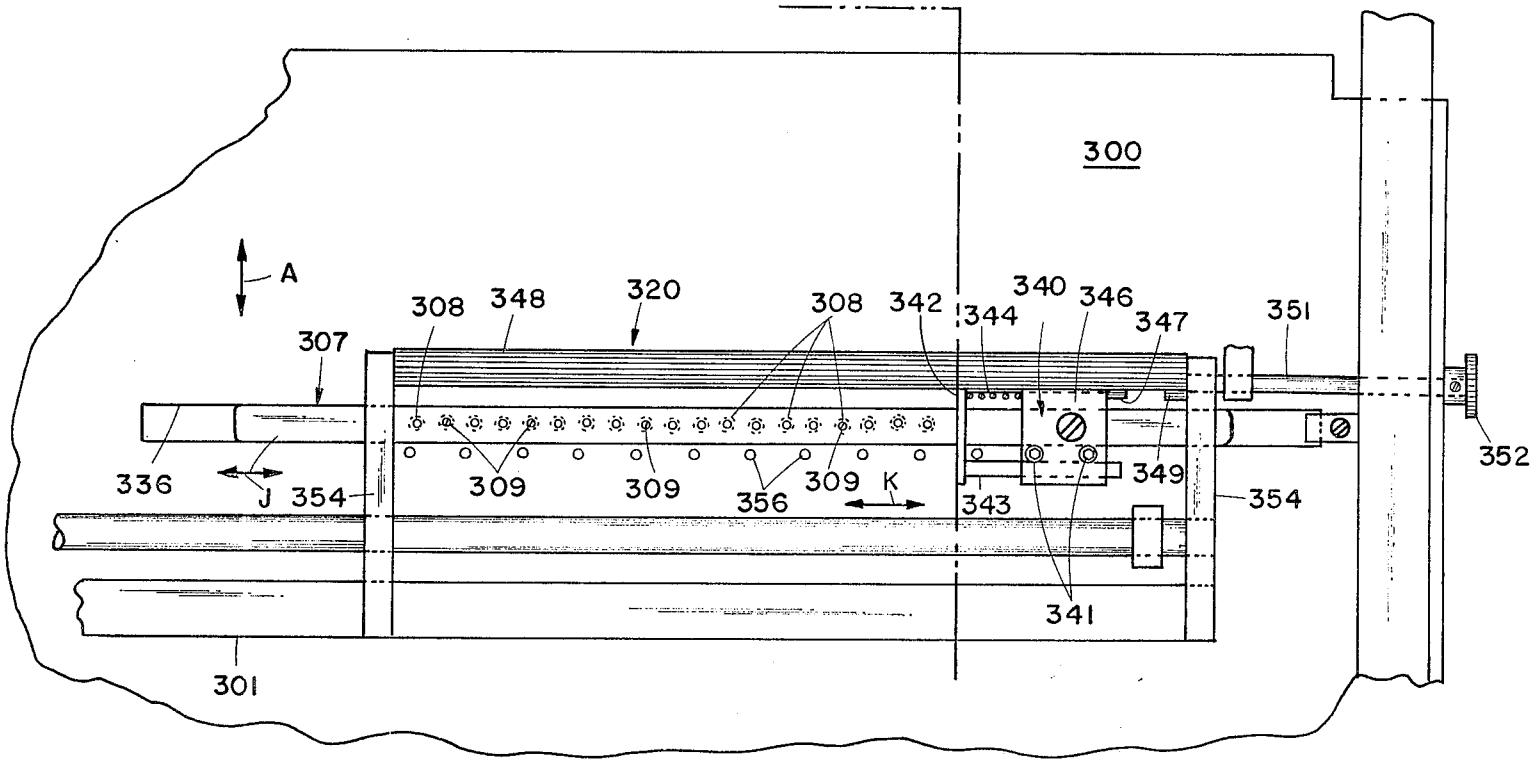
FIG. 24 is a fragmentary, plan view of the right side of an alternative embodiment of the side registration means.
Figure 25:
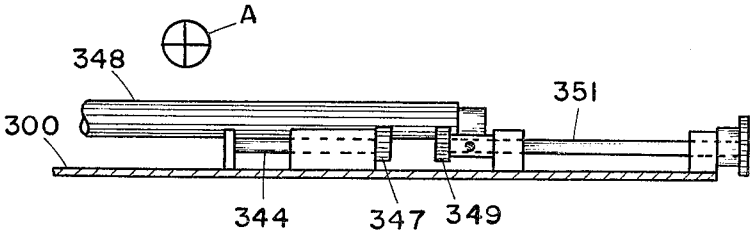
FIG. 25 is a fragmentary, front end elevational view of the structure shown in FIG. 24.

In the alternative embodiment of the side registration means, the right side of which is shown in FIG. 24, pusher plate 291 and its associated adjustment mechanism on the left side is eliminated. Otherwise, the structure is identical to that shown in FIG. 22. Side registration is accomplished by pulling stock 11, via bar 307 (FIG. 24), against adjustable stop 342 (FIG. 24). Valve 390 is, in this embodiment, moved to position R to actuate bar 307.

Figure 27:
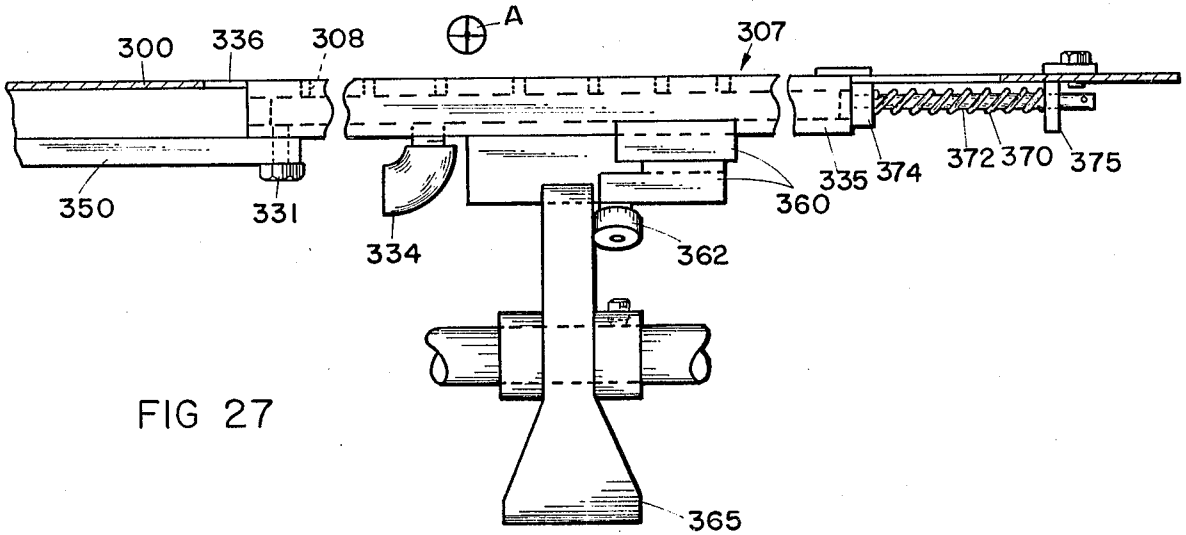
FIG. 27 is a left side elevational view of the drive means shown in FIG. 26.

The right side registration apparatus 320 of the alternative embodiment includes the tubular vacuum bar 307 which has a plurality of spaced threaded apertures 308 therein. Vacuum bars 307 and 310 are interconnected by means of an interconnecting rod 350 (FIG. 27) bolted to the underside of the left end of member 307 by bolt 331, as seen in FIG. 27, and similarly coupled to the underside of the right end of member 310. A vacuum connection 334 from valve 390 communicates with the chamber 335 within member 307 which in turn communicates with each of the apertures 332.

Member 307 also fitss within a slotted aperture 336 in plate 300 to permit lateral motion as indicated by arrow J in FIG. 24. To permit adjustment of the stop member 340 which includes a reference plate 342 mounted on a pair of spaced shafts 343 and 344, a mounting block 346 is provided which receives shafts 343 and 344 with internally threaded gear 347 providing adjustment of plate 342 in the same manner as achieved in block 292 discussed above. Gear 347 at the end of shaft 344 engages the elongated gear 348 in turn engaging a drive gear 349 at the end of an extension shaft 351 extending from the right side of the press outwardly to sprocket 352 as described above.

The elongated gear 348 is rotatably mounted between the hold down arms 354 at opposite ends and which are mounted at ends remote from their interconnection with gear 348 to arm 301. Block 346 is securely bolted to a fixed position on plate 300 by means of bolts 341.

By rotating sprocket 352 with adjustment knob 386 (FIGS. 1 and 22), drive gear 349 rotates the elongated gear 348 which in turn rotates gear 347 attached to the adjustment shaft 344 coupled to plate 342. Thus, plate 342, against which the print stock abuts, can be adjusted as indicated by arrow K in FIG. 24. It is noted here that block 346 can be moved relative to plate 300 by means of the provision of a series of spaced threaded apertures 356, as seen in FIG. 24, for larger adjustments. Block 346 does not, however, move with the vacuum slide members 307 and 310.

In some installations, the registration may be made by moving the printing stock from right to left. In such installations, the adjustable pusher plate or reference stop plate installation is reversed from that shown in FIGS. 22–24. To provide left pull-over registration, valve 290 is switched to position L for actuating vacuum bar 310. In either installation where the vacuum pulling bars are utilized for registration, the gripping force of the bars to the print stock can be adjusted. To achieve this, the threaded apertures 308 of bar 307 can be selectively restricted by flat head screws 309 (FIG. 24). Likewise, the threaded apertures 312 of bar 310 can be selectively restricted by screws 309 (FIG. 22).

Figure 26:
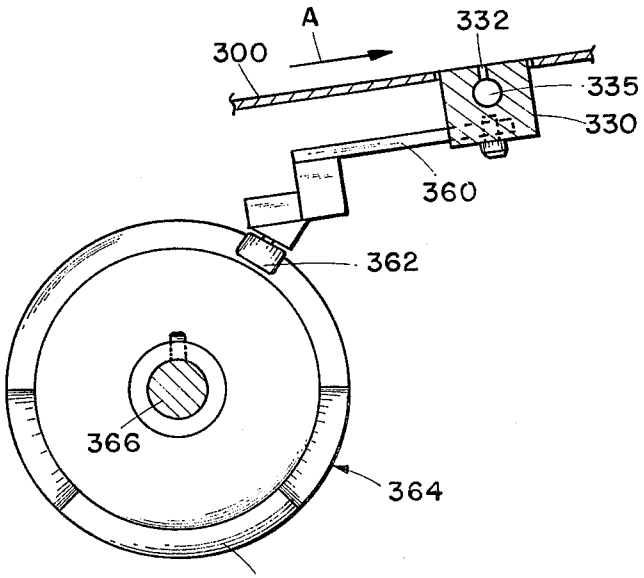
FIG. 26 is a side elevational view partially in cross section showing the drive means for the registration means shown in FIGS. 22–25.

The drive mechanism for simultaneously moving the vacuum slide members 307 and 310 is shown in FIGS. 26 and 27. Coupled to the underside of tubular member 307 is a cam follower arm 360 having a roller cam follower 362 depending downwardly and at an angle from the multiple section arm 360 to engage the edge of a cam 364. Cam 364 is mounted on a rotating shaft 366 interconnected to the print cylinder drive mechanism by chain drive means (not shown). This provides timed side registry prior to the initiation of the print stroke, thereby assuring that the print stock is in position when the print stroke is initiated. Cam 364 includes a raised portion 365 which, when it contacts roller follower 362, forces the tubular members 307, 310 and plate 291 to the right against compression spring 370. Spring 370 surrounds a guide shaft 372 extending from a mounting bracket 374 attached to the right end of member 330 and extending through a sleeve 375 at the right end. As the raised portion 365 of cam 364 rotates beyond roller 362, the vacuum applied to the tubular member is cut off by conventional timed valve means and spring 370 forces the members 307 and 310 back to the left side of the press in preparation of the next cycle of operation. It is noted here that by the time the members move to the left, the cylinder grippers have gripped the sheet stock and the printing operation has begun so that its movement will not affect the registration of the print stock. The print stock is thus pulled by the vacuum pull-over bar 307 against stop 342 which forms the reference for proper stock registration in this embodiment. The adjustability of the system permits side registration of all standard sized print stock as well as non-standard print stock.

It will become apparent to those skilled in the art that various modifications to the printing press described in the preferred embodiment may be made. For example, the guide means for the screen frame may be modified to include, for example, rollers or the like in place of the slides shown. Additionally, other means may be provided for disengaging the screen carriage from the drive means therefor. Also, the crank arm and gear and rack arrangement for the crank back or longitudinal squeegee motion, as described in the preferred embodiment, may be replaced by hydraulic or pneumatic cylinders. These and other modifications will, however, fall within the scope and spirit of the present invention as defined by the appended claims.

The embodiments of the invention in which an exclusive property or privilege is claimed are defined as follows:

1. A stencil screen frame and a carriage for use in screen printing apparatus comprising:

a stencil screen frame including support flanges extending from opposite sides of said frame;

a carriage frame including guide means extending along opposite sides of said carriage frame, said guide means comprising a pair of guide channels defined by spaced elongated guide tracks, said channels coupled to and extending longitudinally and in substantially parallel relationship along opposite sides of said carriage frame to slidably receive and continuously support said support flanges of said stencil screen frame therebetween, said tracks spaced for providing support for opposite surfaces of said support flanges whereby said stencil screen frame can be partially removed from said carriage frame providing access for maintenance of said apparatus; and means coupled to said carriage frame for locking said stencil screen frame in a predetermined position in said carriage frame.

2. The apparatus as defined in claim 1 and further including adjustable means coupling said guide channels to said carriage frame permitting vertical adjustment between said carriage frame and said screen frame supported by said guide channels.

3. The apparatus as defined in claim 2 wherein said carriage frame further includes means for engaging a carriage drive of the printing press; and means for moving said engaging means relative to said carriage frame to selectively disengage said carriage frame from said carriage drive.

4. In a screen printing press, an improved squeegee support mechanism for adjustably supporting a squeegee blade relative to the crown of a print cylinder of the printing press, said support mechanism comprising:

a frame for said press;

a squeegee assembly including a squeegee blade;

support means coupled between said frame and said squeegee assembly for supporting said squeegee blade generally above said printing cylinder, said support means including a pair of support posts positioned on opposite sides of said frame, said support means further including a slide assembly coupled between said squeegee blade assembly and said support post at each end of said squeegee blade assembly, each of said slide assemblies including guide means for movably receiving a slide therein and said guide means are coupled to said support posts;

a gear rack coupled to each of said guide means and a drive gear coupled to said each of said slides and engaging an associated gear rack; and means for simultaneously rotating said drive gears to move said squeegee blade assembly by moving said slides relative to said guide means for moving said squeegee blade longitudinally along the direction of movement of printing stock in the press for adjusting the position of said squeegee blade with respect to the crown of said printing cylinder.

5. The apparatus as defined in claim 4 wherein said guides are elongated to permit said squeegee blade assembly to be moved to an inoperative position.

6. The apparatus as defined in claim 4 wherein said support means further includes a vertical slide assembly at opposite sides of said press for coupling opposite ends of said squeegee blade assembly to said support means for adjusting the relative vertical spacing between said squeegee blade assembly and said printing cylinder of said press.

7. The apparatus as defined in claim 6 wherein said squeegee blade assembly includes a cross arm detachably coupled at each end to one of said vertical slide assemblies and means for adjustably coupling said squeegee blade to said cross arm to permit angular adjustment of said squeegee blade with respect to the print cylinder.

8. In a screen printing press of the type including a reciprocating screen frame carriage for transporting a stencil screen through print and return strokes, improved drive means for said screen carriage comprising:

a frame for the printing press;

at least one drive gear mounted within said frame;

drive means for reciprocally rotating said drive gear through a predetermined arc during print and return strokes of printing operation; and a screen carriage slidably supported on said press frame and including at least one gear rack and means for coupling said gear rack to said carriage for moving said gear rack between operative and inoperative positions with respect to said drive gear, said coupling means including means for selectively moving said gear rack away from said drive gear to selectively disengage said gear rack and said drive gear whereby said screen carriage can be disengaged from said drive means without moving a stencil screen from said screen carriage.

9. The apparatus as defined in claim 8 wherein said carriage includes a rectangular carriage frame and said means for moving includes means for pivotally coupling one end of said gear rack to said carriage frame for pivoting said gear rack between engaging and disengaging positions with respect to said drive gear.

10. The apparatus as defined in claim 9 wherein said moving means further comprises camming means coupled to said carriage frame and to an end of said gear rack remote from said pivot coupling means to pivot said gear rack between engaging and disengaging positions.

11. The apparatus as defined in claim 10 wherein said camming means comprises a cam rotatably coupled to said carriage frame and having a camming surface, a cam follower coupled to said remote end of said gear rack to engage said camming surface of said cam, and means for rotating said cam between first and second positions to pivot said gear rack between engaging and nonengaging positions respectively.

12. The apparatus as defined in claim 11 wherein said cam includes means engaging said follower for locking said cam in said first position.

13. The apparatus as defined in claim 8 and including locking means extending between said screen carriage and said press frame for locking said carriage in a fixed position when said gear rack is disengaged from said drive gear.

14. The apparatus as defined in claim 8 wherein said screen carriage and drive means includes indexing means extending therebetween for engaging said gear rack with said drive gear in predetermined relationship.

15. In a screen printing press including a squeegee assembly having a squeegee blade movable between a lowered position during a print stroke of each cycle of operation to engage a printing screen and elevated out of contact with said printing screen during a return stroke of each cycle of operation, means for controllably lowering the squeegee onto the printing screen at an initial portion of each printing stroke comprising:

a frame for said printing press;

a screen frame carriage slidably mounted to said press frame, said carriage including means for receiving a stencil screen frame having a stencil screen mounted thereto;

drive means coupled to said carriage for reciprocating said carriage between print and return strokes;

a squeegee assembly including a squeegee blade;

support means coupling said squeegee assembly to said press frame for vertical movement therebetween, said support means including squeegee assembly drive means for moving said squeegee assembly toward the printing screen during at least a portion of each printing stroke; and cam means extending between said squeegee support means and said carriage to intercept said squeegee assembly for controllably and gradually lowering said squeegee blade into contact with said screen as the screen carriage advances during the initial portion of each print stroke.

16. The apparatus as defined in claim 15 wherein said cam means includes a block coupled to said carriage and having a configurated camming surface; and movable cam follower means coupled to said press frame and including a follower member for engaging said configurated surface of said block during a portion of each cycle of press operation, said cam follower means positioned on said press frame to cooperate between said support means and said configurated surface to gradually lower said squeegee blade onto the printing screen at the initiation of each printing stroke of a cycle of operation.

17. The apparatus as defined in claim 16 wherein said configurated surface is a surface inclined toward said carriage.

18. The apparatus as defined in claim 17 wherein said cam follower means includes an adjustable stop positioned to engage said squeegee support means.

19. The apparatus as defined in claim 18 wherein said squeegee assembly drive means is coupled to said support means for raising said support means during each return stroke and at the end thereof, rapidly lowering said support means and bias means coupled to said support means for urging said squeegee assembly toward said printing screen.

20. In a screen printing press of the type feeding successive segments of printing stock into a print station and registering the stock with respect to a printing cylinder and screen, improved means providing side registration of said stock comprising:

a frame for said printing press;

a stock support surface coupled to said frame for receiving and supporting printing stock thereon;

means for supplying printing stock to said stock support surface;

a block movably positioned on said stock support surface and including a plate movably coupled thereto by means of a rotatable threaded member, said plate forming an abutment surface for printing stock;

adjustment means extending to an edge of the press and cooperating between said block and said plate to permit adjustment of said plate relative to said block wherein said adjustment means engages said threaded member to rotate said member providing relative motion between said plate and said block and comprises a first gear mounted to said threaded member; a pair of spaced support arms fixedly coupled to said stock support surface; an elongated gear rotatably coupled between ends of said arms to continuously engage said first gear as said block is moved; and means for rotating said elongated gear whereby said first gear rotates to adjust the position of said plate with respect to said block;

vacuum pull-over means movably mounted within said support surface for lateral motion with respect to said feed direction of said printing stock, said pull-over means including a plurality of spaced apertures opening toward said stock support surface for gripping printing stock when positioned thereon and when vacuum is applied to said pull-over means; and drive means coupled to said pull-over means for moving said vacuum pull-over means to urge printing stock into a side registered position against said plate.

21. In a screen printing press of the type feeding successive segments of printing stock into a print station and registering the stock with respect to a printing cylinder and screen, improved means providing side registration of said stock comprising:

a frame for said printing press;

a stock support surface coupled to said frame for receiving and supporting printing stock thereon;

means for supplying printing stock to said stock support surface;

pull-over means movably mounted within said support surface for lateral motion with respect to the feed direction of said printing stock, said pull-over means including a plurality of spaced threaded apertures;

a block bolted to selected apertures of said pull-over means and including a stock pusher plate movably coupled to said block by at least one rotatable threaded member, said plate engaging an edge of printing stock during side registration;

adjustment means extending to an edge of the press and engaging said threaded member to rotate said member to move said plate relative to said block wherein said adjustment means comprises a first gear mounted to said threaded member; a pair of spaced support arms fixedly coupled to said stock support surface; an elongated gear rotatably coupled between ends of said arms to continuously engage said first gear as said block is moved; and means for rotating said elongated gear whereby said first gear rotates to adjust the position of said pusher plate with respect to said block; and drive means coupled to said pull-over means for moving said pull-over means and said block and pusher plate a predetermined distance to provide side registration of printing stock engaged by said pusher plate.

22. The apparatus as defined in claim 21 wherein said drive means comprises a cam follower coupled to said pull-over means, a cam engaging said follower and configurated to shift said pull-over means during registration, and bias means urging said follower against said cam.

23. In a screen printing press, an improved squeegee support mechanism for movably supporting a squeegee between an operative position relative to the crown of a print cylinder of the printing press and in inoperative position spaced longitudinally and away from said print cylinder, said support mechanism comprising:

a frame for said press;

a squeegee assembly including a squeegee blade;

slide means coupled to said squeegee assembly at opposite ends;

support means coupled between said frame and said slide means for supporting said squeegee blade generally above said printing cylinder, said support means including guide means for receiving said slide means and means for moving said slide means in said guide means for moving said squeegee blade longitudinally along the direction of movement of printing stock in the press for moving said squeegee blade with respect to the crown of said printing cylinder, said support means further including means for lifting said squeegee assembly away from said printing cylinder whereby said squeegee assembly can be lifted and longitudinally moved to a position remote from said printing cylinder to provide access to the press for maintenance when in the inoperative position.

* * * * *

UNITED STATES PATENT AND TRADEMARK OFFICE

CERTIFICATE OF CORRECTION

PATENT NO. : 3,941,053

DATED : March 2, 1976

INVENTOR(S) : James A. Black et al

It is certified that error appears in the above-identified patent and that said Letters Patent are hereby corrected as shown below:

Column 2, line 13:
"accurancy" should be --- accuracy ---.

Column 7, line 11:
"cariage" should be --- carriage ---.

Column 7, line 31:
"therof" should be --- thereof ---.

Column 8, line 16:
"breifly" should be --- briefly ---.

Column 11, lines 17 and 18:
"prividing" should be --- providing ---.

Column 13, line 15:
"of" should be --- to ---.

Column 14, line 8:
"rotatiang" should be --- rotating ---.

Column 14, line 10:
"(arrow II)" should be --- (arrow H) ---.

Column 14, line 60:
"selectivley" should be --- selectively ---.

Column 15, line 14:
"fitss" should be --- fits ---.

Signed and Sealed this

Sixth Day of July 1976

[SEAL]

*Attest:*

RUTH C. MASON
*Attesting Officer*

C. MARSHALL DANN
*Commissioner of Patents and Trademarks*